US011147728B2

(12) United States Patent
Börner et al.

(10) Patent No.: US 11,147,728 B2
(45) Date of Patent: Oct. 19, 2021

(54) THERMOTHERAPY DEVICE

(71) Applicant: DRÄGERWERK AG & CO. KGAA, Lübeck (DE)

(72) Inventors: Julia Börner, Lübeck (DE); Eduard Engelsman, Lübeck (DE); Torsten Hindersin, Kamp-Lintfort (DE); Fabian Bergner, Essen (DE)

(73) Assignee: DRÄGERWERK AG & CO. KGAA, Lübeck (DE)

( * ) Notice: Subject to any disclaimer, the term of this patent is extended or adjusted under 35 U.S.C. 154(b) by 461 days.

(21) Appl. No.: 16/303,966

(22) PCT Filed: May 22, 2017

(86) PCT No.: PCT/EP2017/000608
§ 371 (c)(1),
(2) Date: Nov. 21, 2018

(87) PCT Pub. No.: WO2017/202490
PCT Pub. Date: Nov. 30, 2017

(65) Prior Publication Data

US 2020/0315890 A1 Oct. 8, 2020

(30) Foreign Application Priority Data

May 23, 2016 (DE) ..... 10 2016 006 168.5
May 23, 2016 (DE) ..... 10 2016 006 169.3

(51) Int. Cl.
*A61G 11/00* (2006.01)
*A61G 7/005* (2006.01)
*A61G 7/05* (2006.01)

(52) U.S. Cl.
CPC ..... *A61G 11/005* (2013.01); *A61G 7/005* (2013.01); *A61G 7/0507* (2013.01); *A61G 11/009* (2013.01); *A61G 2200/14* (2013.01); *A61G 2200/327* (2013.01); *A61G 2210/90* (2013.01)

(58) Field of Classification Search
CPC .... A61H 11/00; A61H 11/005; A61H 11/008; A61H 7/005
See application file for complete search history.

(56) References Cited

U.S. PATENT DOCUMENTS 6,611,978 B1 9/2003 Schmidt et al.

FOREIGN PATENT DOCUMENTS

CN 2452482 Y 11/2001
CN 101883551 A 9/2002
CN 2508697 Y 3/2003
(Continued)

*Primary Examiner* — John P Lacyk
(74) *Attorney, Agent, or Firm* — McGlew and Tuttle, P.C.

(57) ABSTRACT

A patient bed assembly unit as well as to a thermotherapy device for newborns includes a bed frame and a drawer. The bed frame has a drawer guide configured to make possible a drawer movement from a central pushed-in position in the bed frame along a first pull-out direction and in a second pull-out direction, which direction is opposite the first pull-out direction, into a pulled-out position of the drawer. A drawer-centering device acts on the drawer to move it into the central pushed-in position. The drawer can be removed from the guide. A drawer anti-tilt device is provided, which transmits a torque acting on the drawer directly to a bed frame and prevents the downward tilting of the drawer relative to the bed frame about an axis extending at right angles to the pull-out directions.

25 Claims, 17 Drawing Sheets

(56) References Cited

FOREIGN PATENT DOCUMENTS

| | | | |
|---|---|---|---|
| CN | 104220036 | A | 12/2014 |
| CN | 205181680 | U | 4/2016 |
| DE | 199 16 890 | A1 | 5/2000 |
| DE | 199 08 843 | A1 | 9/2000 |
| DE | 100 62 127 | A1 | 12/2001 |
| DE | 698 20 646 | T2 | 6/2004 |
| WO | 03/017908 | A1 | 3/2003 |
| WO | 2009/073355 | A1 | 6/2009 |
| WO | 2015/070969 | A1 | 5/2015 |

1.)

2.)

3.)

4.)

(a)

(b)

(a)

(b)

THERMOTHERAPY DEVICE

CROSS REFERENCE TO RELATED APPLICATIONS

This application is a United States National Phase Application of International Application PCT/EP2017/000608, filed May 22, 2017, and claims the benefit of priority under 35 U.S.C. § 119 of German Applications 10 2016 006 168.5, filed May 23, 2016 and, 10 2016 006 169.3 filed May 23, 2016, the entire contents of which are incorporated herein by reference.

TECHNICAL FIELD

The present invention pertains to a thermotherapy device, especially an incubator, for newborns, with a patient bed assembly unit.

BACKGROUND

There are two therapeutic approaches in the care of premature babies. In closed care, the infants are placed into thermotherapy devices in the form of closed incubators. These can offer an environment tailored to the needs of the infant with humid, warm and at times oxygen-enriched air. The patient space in an incubator chamber of the incubator comprises a reclining surface on a platform, which is surrounded by side walls. A hood closes the patient area upwardly. To have access to the infant, so-called hand ports in the side walls can be opened or even an entire side wall can be opened when needed.

The second therapeutic approach provides for placing the premature baby into thermotherapy devices in the form of nursing beds, which makes it possible to warm the infant by heating radiators. Compared to the closed incubators, these warming beds offer easier access to the infant for the nursing staff. The side walls protecting the infant from falling out typically have a height of about 150 mm, so that the nursing staff can easily reach into the device over the side walls. The side walls of an incubator are typically higher, because a certain volume of air is needed within the incubator and in order to make better access to the infant possible when the side walls are opened.

Hybrid devices are thermotherapy devices that combine the device types of a closed incubator and a warming bed. To arrive at open care from closed care, a hood is removed from the side walls and the infant is warmed by means of heating radiators. Access to the infant is thus rather unfavorable with the side walls closed and the hood opened, since the nursing staff must reach over the side walls into the patient area in an awkward manner or fold down the side walls. The infant must not be left unattended at any time with the side walls folded down. One approach points in the direction of reducing the height of the side walls and of providing additional volume by means of a high hood. However, this leads to reduced freedom in working in the closed care (hood closed) with the side wall opened.

Both incubators for closed care, nursing beds for open care and hybrid devices will be covered below under the term thermotherapy device. It is common to all thermotherapy devices that they have a patient bed, on which the newborn can lie. Provisions are also made in many cases in this connection for a so-called X-ray drawer to be located under the reclining surface. An X-ray drawer is defined as a receptacle, which is arranged under the reclining surface and into which an X-ray cassette can be inserted, so that the newborn can undergo diagnostic X-ray while lying on the patient bed located above the X-ray drawer.

For example, DE 100 62 127 A1 discloses a thermotherapy device, in which the reclining surface with an X-ray drawer arranged under it can be pulled out of the device. DE 199 16 890 A1 also discloses an X-ray drawer, which is arranged under the reclining surface in an incubator.

The reclining surface, along with the bed frame, in which the reclining surface is arranged, and the X-ray drawer located under it are also considered to be a patient bed assembly unit. If present, additional components, which are used to hold and mount the bed frame, may also belong to the patient bed assembly unit.

The X-ray drawers known from the state of the art often have certain disadvantages, which shall be overcome in the course of the present invention. Thus, it is desirable, for example, for the X-ray drawer to be able to be pulled out in different directions in order to make it possible to guarantee good access to the drawer. At the same time, the drawer shall, however, also be oriented reliably in a defined position while an X-ray is being taken. It is desirable that the drawer have a certain stability against tilting in the pulled-out state.

SUMMARY OF THE INVENTION

An object of the present invention is therefore to provide an improved patient bed assembly unit for a thermotherapy device for newborns. The patient bed assembly unit shall have, for example, an improved X-ray drawer. In addition, one object of the present invention is to provide an improved thermotherapy device with such an improved patient bed assembly unit. In any case, the patient bed assembly unit shall be able to be manufactured in as cost-effective manner and as simply as possible. It is also an object of the present invention, for example, to provide a thermotherapy device for newborns, which makes possible a flexible and comfortable care of the newborn with a simple and safe construction.

The present invention provides a patient bed assembly unit for a thermotherapy device for newborns as well as a thermotherapy device with such a patient assembly unit.

In a first embodiment of a patient bed assembly unit for a thermotherapy device for newborns, the present invention makes provisions for the patient bed assembly unit to comprise a bed frame, a drawer and a drawer-centering device, wherein the bed frame has a guide for a drawer, wherein the drawer can be moved by means of the guide from a central position into both a first pulled-out position and a second pulled-out position, wherein the movement of the drawer from the central position into the first pulled-out position takes place along a first pull-out direction and wherein the movement of the drawer from the central position into the second pulled-out position takes place along a second pull-out direction, wherein the second pull-out direction is opposite the first pulled-out position, so that the first pulled-out position and the second pulled-out position are arranged on mutually opposite sides of the thermotherapy device, and wherein the drawer-centering device acts on the drawer during an approach of the drawer to the central position along the first or second pull-out direction with a force such that the drawer is guided into the central position and is held.

The patient bed assembly unit is in this connection the part of the thermotherapy device that comprises the reclining surface. The reclining surface is typically a mattress. The mattress is placed in a bed frame. The bed frame may have a corresponding receptacle for the mattress. It is also conceivable that the mattress simply lies on the bed frame, without a special receptacle being formed. The bed frame is equipped with corresponding positioning and/or mounting means, which make it possible to install the bed frame into a thermotherapy device. For example, the bed frame may have projections or recesses, which can be caused to mesh with corresponding projections or recesses of the thermotherapy device in a positive-locking manner, so that the bed frame is positioned in the thermotherapy device.

The drawer of the patient bed assembly unit is preferably an X-ray drawer, as described above. An X-ray cassette may thus be placed into the drawer. The drawer is preferably arranged in the patient bed assembly unit such that it is arranged under the reclining surface of the patient bed assembly unit in the closed state. The closed state of the drawer is also called the central position or, in other words, the central position represents the closed state of the drawer. The drawer is arranged centrally under the reclining surface in the central position. This offers the advantage that an infant, who is lying on the reclining surface, can be X-rayed directly in the thermotherapy device. It is consequently unnecessary to remove the infant from the thermotherapy device for the corresponding diagnostic X-ray. It is rather possible to proceed simply as follows: The drawer is first pulled out of the central position, so that the drawer is in an opened state. This opened state is also called the first or second pulled-out position, as will be described in more detail below. An X-ray cassette is placed next into the opened drawer. The drawer is closed again, i.e., it is moved back into the central position. The X-ray cassette is now under the infant lying on the reclining surface. If X-ray radiation is now sent from the top in the direction of the reclining surface, the X-ray picture of the infant is recorded by means of the X-ray cassette, without the infant having to be removed from the reclining surface or even from the thermotherapy device.

It is seen in this connection that it is especially advantageous if the bed frame has a guide for the drawer and if a drawer-centering device is provided.

The drawer can be moved to and fro between the central position, the first pulled-out position and the second pulled-out position by means of the guide. The drawer is opened in both the first pulled-out position and the second pulled-out position. The first pulled-out position is located on one side of the patient bed assembly unit and the second pulled-out position is located on the opposite side of the patient bed assembly unit. It is consequently seen that the central position is located between the first and second pulled-out positions. In other words, when standing in front of the patient bed assembly unit, the drawer can be pulled out of the patient bed assembly unit from the central position both to the right and to the left. The movement of the drawer from the central position into the first pulled-out position takes place in a first pull-out direction. The movement of the drawer from the central position into the second pulled-out position takes place in a second pull-out direction. The first pull-out direction and the second pull-out direction are opposite each other. It is conceivable, for example, that the guide is formed simply by one or more rails, on which the drawer can slide to and fro in the first pull-out direction and in the second pull-out direction.

The drawer-centering device is used to align the drawer in the central position as accurately as possible. For example, it can be ensured by means of this device that the drawer always reaches the correct position for the recording when it is closed. This is especially helpful for preventing the drawer from being either pushed out beyond the central position or already stopping at a short distance before the central position. It is therefore advantageous if provisions are made for the drawer-centering device to act on the drawer with a force. This force acts both against the first pull-out direction and the second pull-out direction and it always pushes or pulls the drawer into the central position when the drawer is in the vicinity of the central position. Consequently, a force that is stronger than the force exerted by the drawer-centering device must be applied to pull out the drawer in the first pull-out direction to the first pulled-out position. This also applies to the pulling out of the drawer in the second pull-out direction to the second pulled-out position.

The drawer can be removed from the guide. This is also especially advantageous for cleaning purposes.

In other words, a patient bed assembly unit according to the present invention for a thermotherapy device for newborns comprises a bed frame and a drawer. The bed frame has a guide for the drawer. The guide is configured to make possible a movement of the drawer from a central, pushed-in position in the bed frame along a first pull-out direction of the guide into a pulled-out position of the drawer, and to make possible a movement of the drawer from the central, pushed-in position in the bed frame along a second pull-out direction of the guide, which latter direction is opposite the first pull-out direction, into a pulled-out position of the drawer. A drawer-centering device is provided, which acts on the drawer such as to move it into the central pushed-in position.

This makes possible the flexible care of the newborn, because an X-ray cassette or an X-ray detector can be received, for example, in the drawer and hence directly in the patient bed assembly unit, and an incubator with the patient bed assembly unit can be used in a flexible manner in both pull-out directions.

A drawer anti-tilt device, which prevents the drawer from tilting downward relative to the bed frame about an axis at right angles to the pull-out directions, may preferably be provided. Tilting of the drawer relative to the bed frame can be prevented in this manner even under a load on the drawer in the pulled-out position.

In a second embodiment of a patient bed assembly unit for a thermotherapy device for newborns, provisions are made in the present invention for the patient bed assembly unit to comprise a bed frame, a drawer and a drawer anti-tilt device, wherein the bed frame has a guide for the drawer, wherein the drawer can be moved by means of the guide from a central position to both a first pulled-out position and a second pulled-out position, wherein the movement of the drawer from the central position into the first pulled-out position takes place along a first pull-out direction and wherein the movement of the drawer from the central position to the second pulled-out position takes place along a second pull-out direction, wherein the second pull-out direction is opposite the first pull-out direction, so that the first pulled-out position and the second pulled-out position are located on mutually opposite sides of the thermotherapy device, wherein the drawer anti-tilt device transmits a torque acting on the drawer directly to the bed frame, and wherein the drawer anti-tilt device prevents a downward tilting of the drawer relative to the frame about an axis extending at right angles to the pull-out direction.

In other words, the present invention further pertains to a patient bed assembly unit for a thermotherapy device for newborns, wherein the patient bed assembly unit comprises a bed frame and a drawer, wherein the bed frame has a guide for the drawer, which is configured to make possible a movement of the drawer from a central, pushed-in position in the bed frame along at least one pull-out direction of the guide into a pulled-out position of the drawer, and wherein the drawer can be removed from the guide. A drawer anti-tilt device is provided, which transmits a torque acting on the drawer directly to the bed frame and prevents the drawer from tilting downward relative to the bed frame about an axis extending at right angles to the pull-out directions.

A drawer-centering device, which acts on the drawer to move it into the central, pushed-in position, is preferably also present in this embodiment. The central, pushed-in position is the central position. The drawer can be positioned in this manner reliably in a defined position, as a result of which additional components of an incubator are not compromised by an incorrect position of the drawer and reliable positioning of the X-ray cassette and of the X-ray detector is made possible in case of use for taking X-ray pictures and faulty pictures can be avoided.

It is conceivable for both the above-described first embodiment and the above-described second embodiment of the patient bed assembly unit that the drawer-centering device has at least one drawer-centering element.

Such a drawer-centering element may be, for example, a mechanical element, or also a magnetic element. A mechanical element may have, for example, one or more springs, which act on the drawer directly or indirectly with a force. A drawer-centering element is thus characterized in that it exerts a force on the drawer. It is also conceivable that the drawer-centering device has a plurality of drawer-centering elements.

For example, the drawer-centering device has a first mechanical drawer-centering element in the guide and a second mechanical drawer-centering element in the drawer, which mesh with one another in a positive-locking manner in the central pushed-in position of the drawer. This makes possible a simple configuration of the device in a mechanical manner.

It is also possible that the drawer-centering device has a first magnetic drawer-centering element in the guide and a second magnetic drawer-centering element in the drawer, in which case the magnetic forces act on the drawer between the first and second magnetic drawer-centering elements to move it into the central, pushed-in position. This makes possible a contactless action leading to movement into the central, pushed-in position.

The magnetic drawer-centering elements may be inserted, in particular, into recesses of plastic components of the bed frame and the drawer and the recesses are closed with a cover and are welded together by ultrasonic welding, as a result of which simple cleaning of the assembly unit is made possible. As an alternative, the magnetic drawer-centering elements may be cast in or inserted by bonding.

For example, the drawer and the bed frame may have end position elements each, which define a fully pulled-out position in the respective pull-out directions and block a further pulling out of the drawer in the fully pulled-out position and/or act on the drawer to move it into the fully pulled-out position. This prevents the drawer from falling out in an unintended manner and gives the user a haptic feedback when pulling out the drawer.

The end position elements may be configured as mechanical stop elements and be in contact with one another in a positive-locking manner in the fully pulled-out position.

A drawer-removing device, which makes it possible to separate the positive-locking connection of the stop elements and the removal of the drawer from the bed frame, is preferably provided. Removal of the drawer in a specific manner is made possible in this manner, as a result of which, for example, the cleaning of the patient bed assembly unit can be facilitated.

The drawer preferably has a first positioning mark, which is configured such that it coincides with a second positioning mark on the bed frame and/or on a component of a thermotherapy device belonging to the patient bed assembly unit, especially a side wall or side panel in the central, pushed-in position of the drawer. This makes possible a simple and reliable positioning of an X-ray cassette or of an X-ray detector in the drawer relative to the position of the newborn on a reclining surface of the patient bed assembly unit.

The present invention further pertains to a thermotherapy device for newborns with an incubator chamber and with an above-described patient bed assembly unit.

The thermotherapy device according to the present invention for newborns comprises a patient bed assembly unit and a positioning device for the patient bed assembly unit, wherein the positioning device has a first horizontal rail in the area of a first end face of the thermotherapy device and a second horizontal rail in the area of a second end face of the thermotherapy device. The patient bed assembly unit comprises a bed frame, which has a first guide and a second guide for the horizontal rails, wherein the rails are configured to make possible a movement of the bed frame from a central position in the thermotherapy device along a first pull-out direction of the horizontal rails into a pulled-out position of the bed frame, and to make possible a movement of the bed frame from the central position in the thermotherapy device along a second pull-out direction of the horizontal rails, which latter direction is opposite the first pull-out direction, into a pulled-out position of the bed frame.

This makes possible a flexible and comfortable care of the newborn because the bed frame can be pulled at least partially out of the incubator chamber. Due to the bilateral pull-out directions, the incubator can be used in a flexible manner. Another thermotherapy device according to the present invention for newborns comprises a patient bed assembly unit and a positioning device for the patient bed assembly unit, wherein the patient bed assembly unit comprises a bed frame. The bed frame and the positioning device are configured to make possible a movement of the bed frame from a desired position relative to the positioning device along at least one pull-out direction into a pulled-out position of the bed frame and to make possible the removal of the bed frame from the positioning device in a vertical direction, wherein an anti-tilt device is provided, which prevents the tilting of the bed frame about an axis extending at right angles to the horizontal rails in the desired position and in the pulled-out position.

The positioning device is preferably configured to make possible the removal of the bed frame from the incubator chamber in a vertical direction. The incubator can be cleaned in this manner, for example, in a simple manner.

An anti-tilt device, which prevents the tilting of the bed frame about an axis extending at right angles to the horizontal rails in the central position and in a pulled-out position, is preferably provided. Tilting of the bed frame is also prevented in this manner in case of a load on the bed frame in the pulled-out position.

For example, the anti-tilt device has, at at least one of the guides of the bed frame, a first undercut section and a second undercut section, which are located at spaced locations from one another in the pull-out direction and wherein both undercut sections extend at least partially around the associated horizontal rail in the vertical direction in the central position. Tilting of the bed frame is prevented in this manner both in the pulled-out positions and in the central position in a simple mechanical manner.

The horizontal rails may have an expansion device, which can be moved from a first position into a second position, the length of the horizontal rails in the pull-out direction in the second position of the expansion device being greater than the length of the horizontal rails in the pull-out direction in the first position of the expansion device. The horizontal rails can be shortened in this manner, for example, for removing the bed frame.

A height adjustment device, which is configured to set the height of the first and second horizontal rails individually, especially relative to an incubator chamber, is preferably provided. This makes it possible to adjust the bed vertically and to tilt the bed.

The horizontal rails are configured, for example, as T-shaped carriers, which comprise each a horizontal rail element and a central vertical support element. This makes possible a simple construction, in which the bed frame can be pulled out in a simple manner up to the position of the support element.

To make possible a reliable positioning of the bed frame in the incubator chamber, a centering device is preferably provided, which acts on the bed frame to move it into a central position.

The centering device has, for example, a first mechanical centering element in the guide and a second mechanical centering element in the rail, which mesh with one another in a positive-locking manner in the central position of the bed frame. This makes possible a simple mechanical positioning of the bed frame.

It is also possible that the centering device has a first magnetic centering element in the guide and a second magnetic centering element in the rail, the magnetic forces between the first and second magnetic centering elements acting on the bed frame to move it into the central position. This make possible a contactless action to bring about a movement into the central position. For example, the magnetic centering elements may be integrated in the bed frame and in the rail, for example, cast in or inserted into a recess, which is subsequently covered with a cover and welded or bonded in, as a result of which simple cleaning of the centering device is made possible. The two magnetic centering elements may be, for example, two permanent magnets or one permanent magnet and one magnetizable component, for example, a ferromagnetic element.

The patient bed assembly unit preferably comprises a drawer, which can be pulled out of a pushed-in position in at least one of the pull-out directions. For example, a receptacle of an X-ray cassette or of an X-ray detector may be formed in his manner, which is arranged directly under the reclining surface of the newborn, as a result of which X-ray pictures of the newborn can be made without the newborn having to be removed from the incubator, and this can be done with a relatively low radiation dose.

To prevent the bed frame from tilting under a load on the pulled-out drawer, a locking device may be provided, which locks the horizontal rail in an at least partially pulled-out position of the drawer in order to prevent tilting of the bed frame, and it releases the horizontal rail in a pushed-in position of the drawer in order to make it possible to remove the bed frame from the positioning device.

Further features and advantages of the present invention appear from the following description and from the drawings, to which reference will be made. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
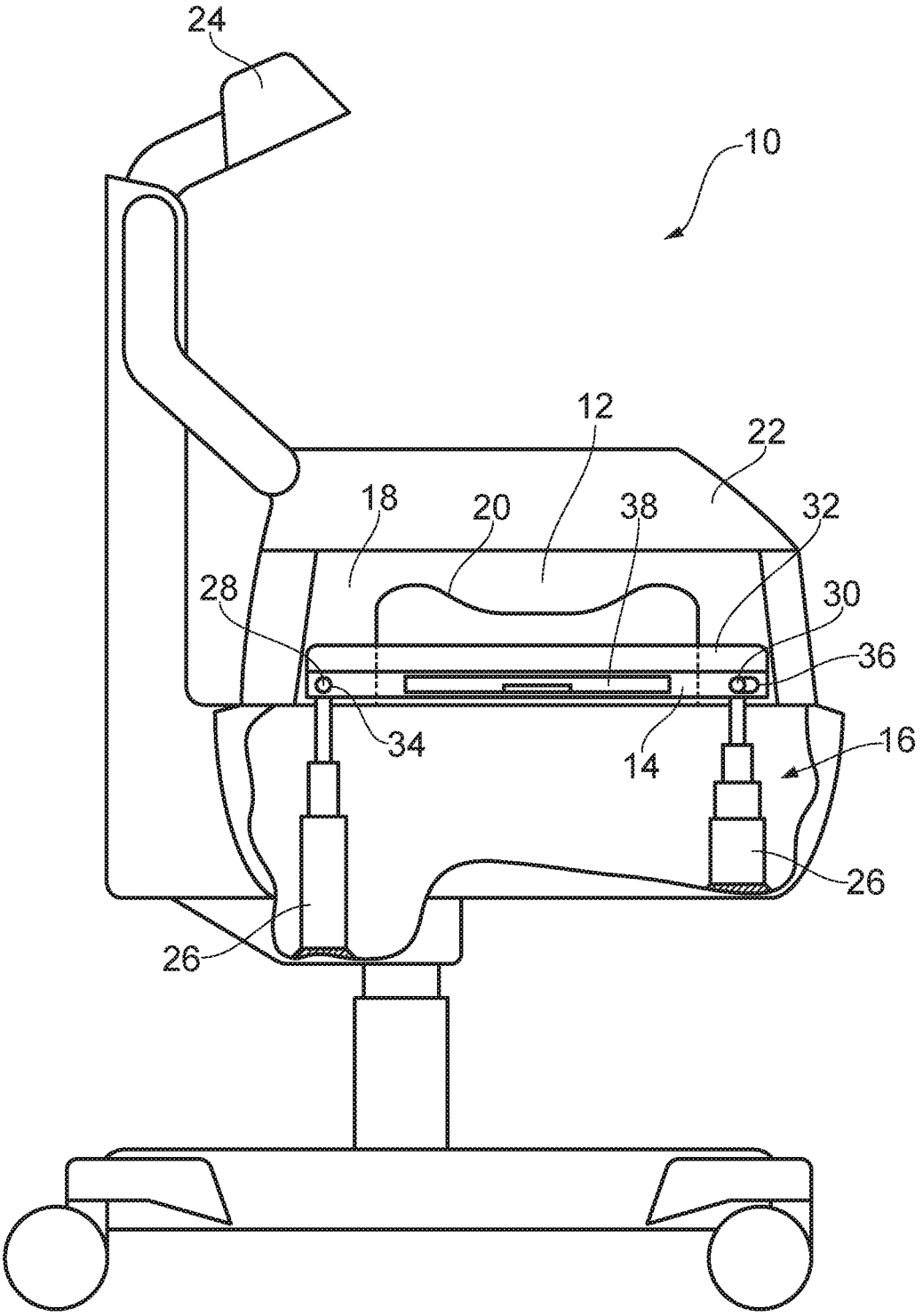
FIG. 1 is a partial sectional view of an incubator according to the present invention.
Figure 2:
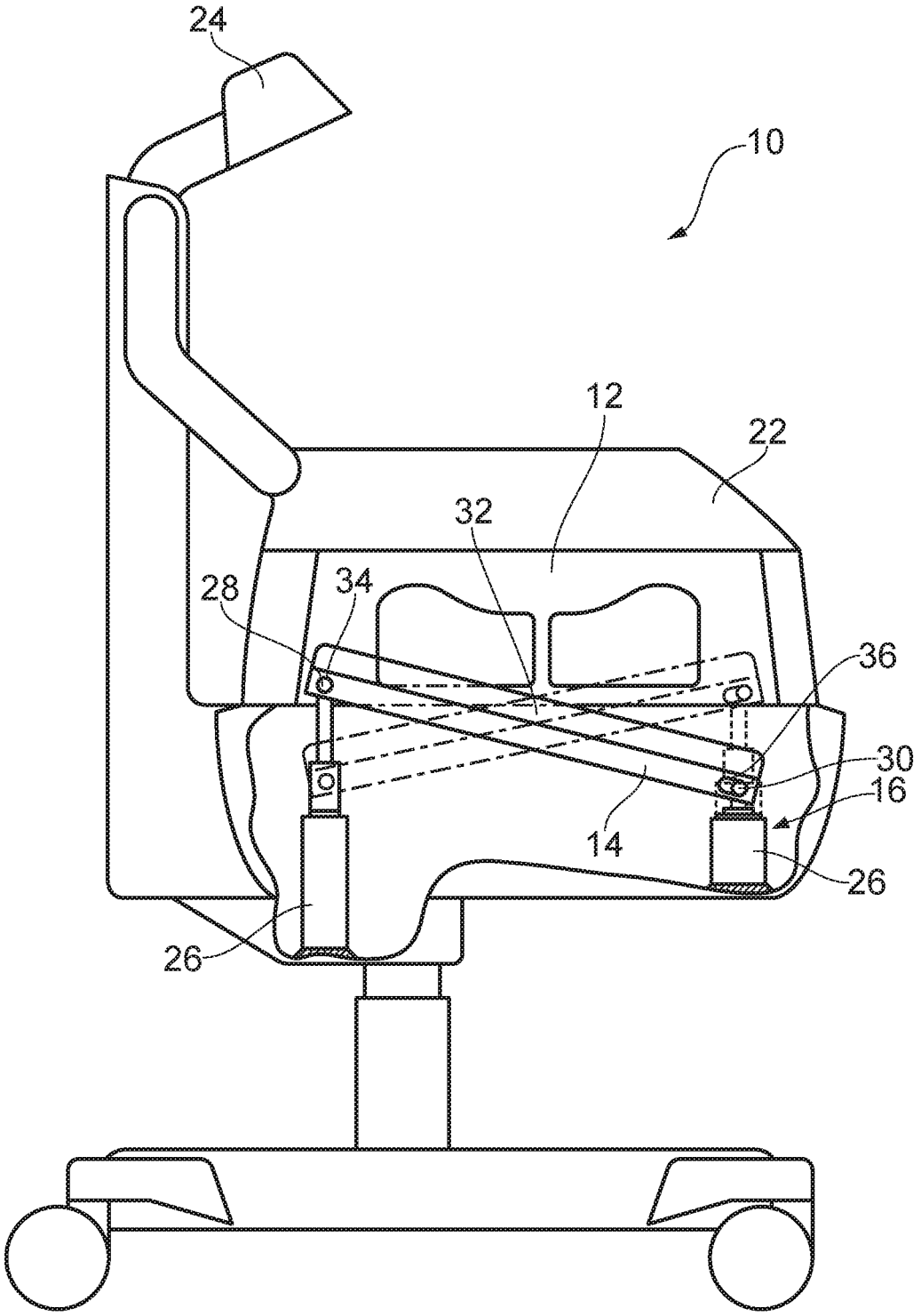
FIG. 2 is a schematic view of the incubator from FIG. 1 with adjusted bed frame position.

Referring to the drawings, FIGS. 1 and 2 show a thermotherapy device 10 in the form of a hybrid device. The thermotherapy device 10 may, however, also be a closed incubator or an open warming bed. The thermotherapy device 10 will hereinafter also be called incubator 10.

The incubator 10 comprises an incubator chamber 12, a patient bed assembly unit 14 within the incubator chamber 12 and a positioning device 16 for the patient bed assembly unit 14.

The incubator chamber 12 has side walls 18 with access openings 20, which can be opened in order to reach into the incubator chamber 12. A hood 22 closes the incubator chamber 12 upwardly. The hood 22 may be opened for open care. A heating lamp 24 is provided in order to warm the newborn in open care. A thermotherapy device according to the present invention may, however, also have a different configuration, for example, a configuration as a closed incubator without a hood that would be opened.

The positioning device 16 comprises a height adjustment advice 26, in the embodiment shown in the form of two telescoping lifting devices, and a first horizontal rail 28 in the area of a first end face of the incubator chamber 12 as well as a second horizontal rail 30 in the area of a second end face of the incubator chamber 12. The height adjustment device 26 is configured to set the height of the first and second horizontal rails 28, 30 individually relative to the incubator chamber 12 and relative to the housing of the incubator 10. A different configuration may be provided as well.

The patient bed assembly unit 14 comprises a bed frame 32, which has a first guide 34 and a second guide 36 for the horizontal rails, the horizontal rails 28, 30 being mounted in the guides 34, 36.

The patient bed assembly unit 14 further comprises a drawer 38, which is arranged under a reclining surface of the patient bed assembly unit 14. The drawer is used especially to receive an X-ray cassette or an X-ray detector and thus make it possible to take X-ray pictures of the newborn within the incubator chamber 12.

The patient bed assembly unit 14 further has a reclining surface element (not shown in FIG. 1), which is supported by the bed frame 32, and a mattress (not shown in FIG. 1), which forms a reclining surface for the newborn. The reclining surface element and the mattress are preferably configured such that they absorb and scatter only a small quantity of X-ray radiation in order to make it possible to take X-ray pictures with the lowest possible radiation dose. It is also possible for the reclining surface element to be configured in one piece with the bed frame or in one piece with the mattress.

FIG. 2 shows the incubator 10 from FIG. 1 with the height adjustment device 26 set to different positions. Since the heights of the horizontal rails 28, 30 can be set individually by the height adjustment device 26, it is possible to position the patient bed assembly unit 14 horizontally at different heights, on the one hand, and, on the other hand, as is shown in FIG. 2, to position it in different oblique positions, wherein the horizontal rails 28, 30 are set to different heights. Flexible and versatile positioning of the newborn as well as comfortable performance of the nursing actions are made possible in this manner. The drawer 38 is not shown in FIG. 2 for clarity's sake.

Figure 3:
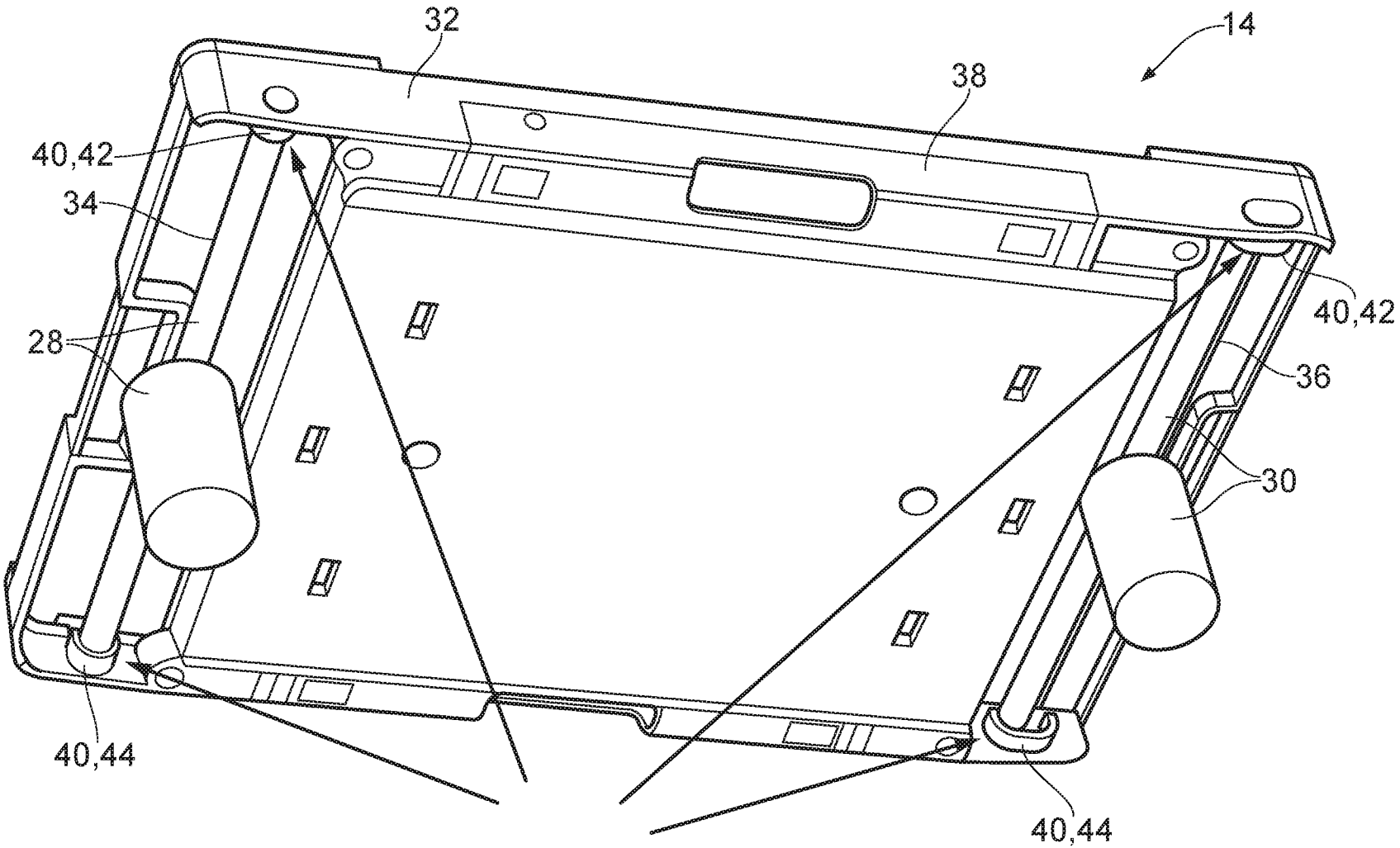
FIG. 3 is a perspective view of a bed frame and of two horizontal rails of an incubator according to the present invention.

FIG. 3 shows a perspective view of the two horizontal rails 28, 30 as well as of the patient bed assembly unit 14 with bed frame 32 and drawer 38. The horizontal rails 28, 30 are configured in the embodiment being shown as T-shaped carriers, which comprise each a horizontal rail element and a central vertical support element. The horizontal rails may, however, also be configured in another way. For example, the vertical support elements may also be provided each at the ends of the horizontal rail elements, in which case the geometry of the guides 34 and 36 must be adapted correspondingly.

The bed frame 32 may be built from one part or from a plurality of parts.

The two guides 34, 36 form a type of fast and loose mount for the two horizontal rails 28, 30 in order to make possible the tilting of the bed frame 32, as is shown in FIG. 2. The first guide 34 for the first horizontal rail 28 forms a fixed mount, and the guide 34 tightly encloses the rail 28 at least in some sections and makes possible, on the one hand, a rotation about the axis of the rail 28 and, on the other hand, sliding on the rail in the direction of the axis of the rail 28. Respective side walls of the bed frame 32, in which a hole each is formed, through which the horizontal rail element of the first rail 28 can pass, are provided at the outer ends of the guide 34.

The second guide 36 for the second horizontal rail 30 forms a loose mount, wherein the second guide 36 makes it possible to mount the second rail 28 in a variable range of distances relative to the first guide 34. The different distance of the horizontal rails 28, 30 in the horizontal position of the bed frame 32 (FIG. 1) and in the oblique position of the bed frame 32 (FIG. 2) can be compensated in this manner. Analogously to the first guide 34, the second guide 36 makes possible, on the one hand, a rotation about the axis of the rail 30 and, on the other hand, sliding of the rail in the direction of the axis of the rail 30. Respective side walls of the bed frame 32, in which an elongated hole each is formed, through which the horizontal rail element of the second rail 30 can pass, are provided at the outer ends of the guide 36.

The guides 34, 36 are thus configured such as to make possible a movement of the bed frame 32 from a central position in the incubator chamber 12 along a first pull-out direction of the horizontal rails 28, 30 into a pulled-out position of the bed frame 32 and a movement of the bed frame 32 from the central position in the incubator chamber 12 along a second pull-out direction of the horizontal rails 28, 30, which direction is opposite the first pull-out direction, into a pulled-out position of the bed frame 32.

Due to the configuration of the first and second horizontal rails 28, 30 as T-shaped carriers, the bed frame 32 can thus be pulled out in a simple manner up to the position of the (central vertical) support element. The central vertical support element thus forms a stop and thus defines a maximally pulled-out position of the bed frame 32 in both pull-out directions.

Figure 4:
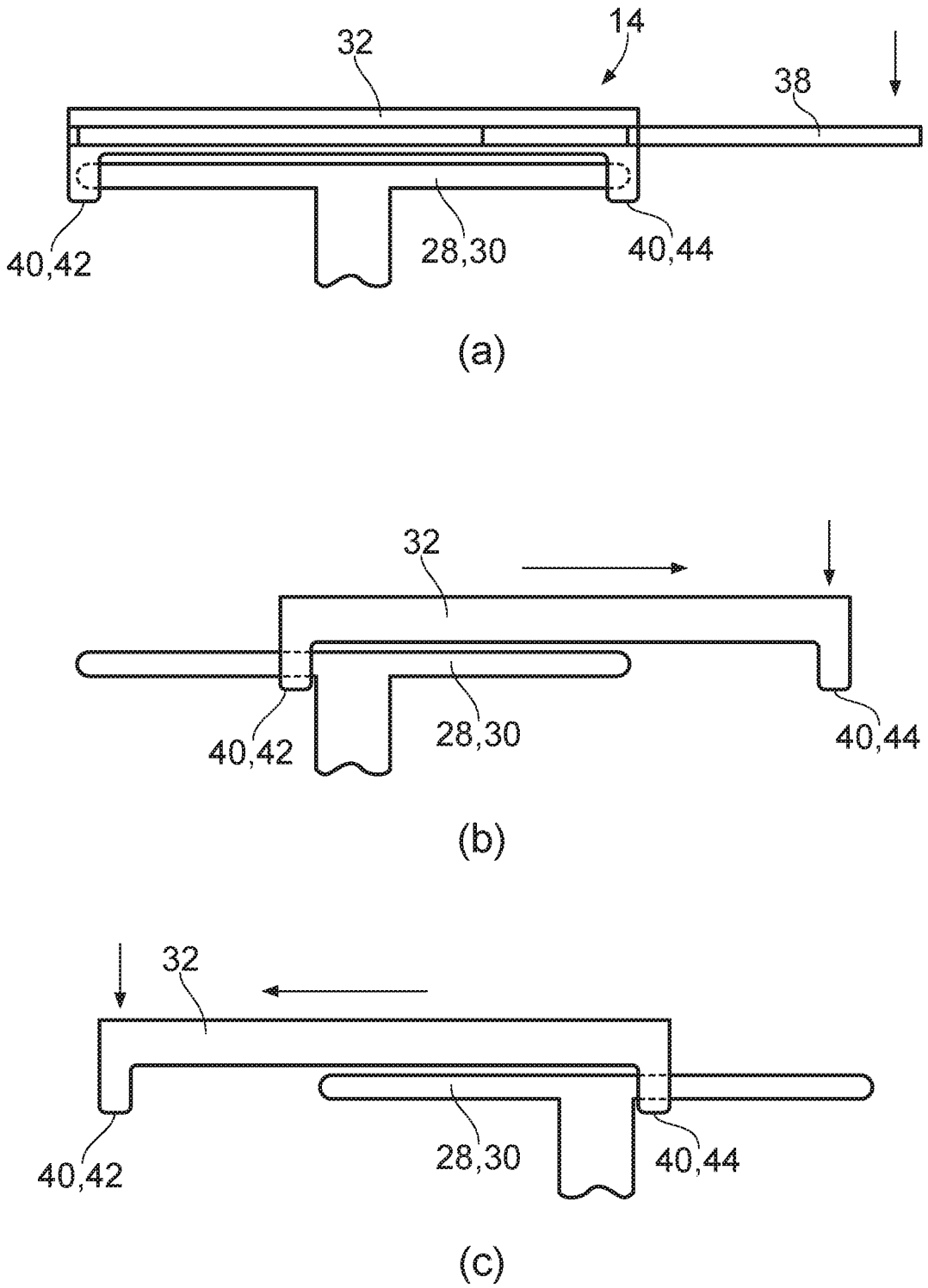
FIG. 4 is a schematic view of a bed frame and of two horizontal rails of an incubator according to the present invention in the central position and in pulled-out positions.

In the embodiment shown in FIG. 4, the holes in the side walls of the bed frame 32 form an anti-tilt device 40, which prevents tilting of the bed frame 32 about an axis extending at right angles to the horizontal rails 28, 30 both in the central position and in a pulled-out position. Tilting of the bed frame 32 is prevented in this manner especially also under a load on the bed frame in the pulled-out position.

With the two respective holes in the side walls of the bed frame 32 of the two guides 34, 36, the anti-tilt device 40 forms a first undercut section 42 and a second undercut section 44, which are located at spaced locations from one another in the pull-out direction, and wherein both undercut sections 42, 44 extend in the central position at least partially around the associated horizontal rail in the vertical direction. The holes in the side walls are reinforced for this in the embodiment shown in FIG. 4 in a tunnel-shaped manner to form the undercut sections 42, 44. This makes it possible to form an undercut in the central position of the bed frame 32 even in case of short horizontal rails 28, 30, which are shorter than the length of the guides 34, 36 of the bed frame 32. Tilting of the bed frame 32 is prevented in this manner both in the pulled-out positions and in the central position in a simple mechanical manner.

The possibility of pulling the bed frame 32 out of the central position makes possible a flexible and comfortable care of the newborn. The incubator 10 can be used in a flexible manner due to the pull-out directions available on both sides.

In section (a), FIG. 4 shows the bed frame 32 in the central position thereof, wherein the drawer 38 is partially pulled out of the bed frame 32. A load on the drawer 38, which is represented by a vertical arrow, generates a torque acting on the patient bed assembly unit 14 with the bed frame 32. The torque is transmitted to the horizontal rails 28, 30 by the anti-tilt device 40 with the undercut sections 42, 44, which extend each around the horizontal rails 28, 30 in the central position of the bed frame, and tilting of the bed frame is prevented.

Section (b) of FIG. 4 shows the bed frame 32 pulled out in the right pull-out direction, wherein the first undercut section 42 encloses the horizontal rails 28, 30 and prevents tilting in case of a load on the anti-tilt device 40.

Section (c) of FIG. 4 shows the bed frame 32 pulled out in the left pull-out direction, wherein the second undercut section 44 encloses the horizontal rails 28, 30 and prevents tilting in case of a load on the anti-tilt device 40.

The incubator 10 is configured to make it possible to remove the bed frame 32 from the incubator chamber 12 in a vertical direction. The incubator can, for example, be removed and cleaned in a simple manner.

Figure 5:
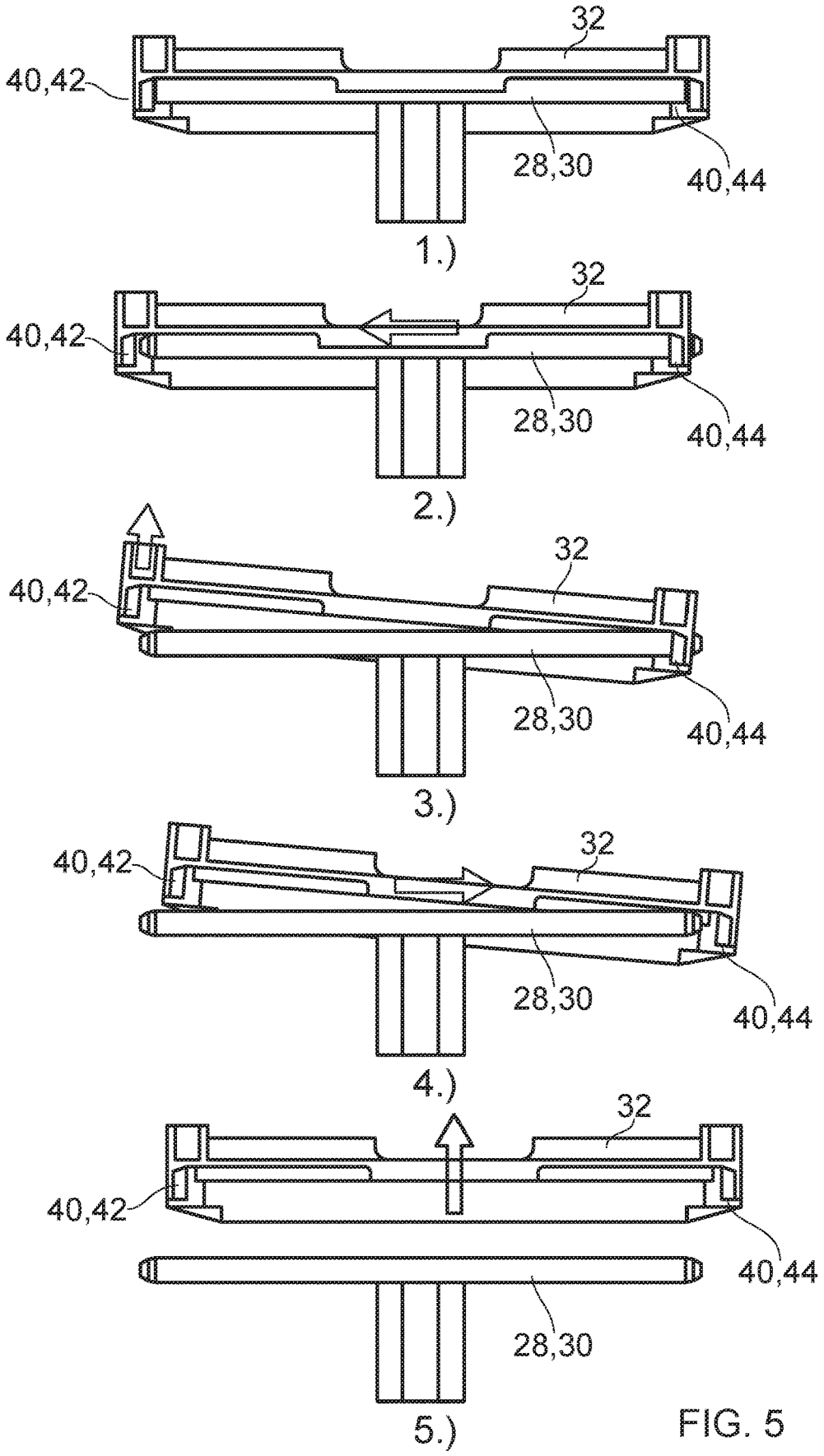
FIG. 5 is a schematic view showing a process for removing a bed frame in case of an anti-tilt device according to a first embodiment.

The removal of the bed frame 32 is shown in the process steps shown in FIG. 5. The bed frame 32 is in its central position in the first step. The bed frame 32 is pushed to the left in the second step until the horizontal rail 28, 30 has reached the area of the first undercut section 42. The bed frame 32 is raised in the third step on the left-hand side, and it is pushed to the right in the fourth step until the horizontal rail 28, 30 has left the area of the second undercut section 44. The bed frame 32 is raised in the fifth step on the right side and can be removed from the incubator chamber 12. The mounting of the bed frame is carried out analogously in the reverse order. Since the construction of the bed frame 32 and of the rails 28, 30 is symmetrical, the direction may also be reversed.

In the embodiment shown, the rails 28, 30 and the bed frame 32 are configured such that the bed frame can also be mounted rotated by 180°, so that the guide 36 lies on the rail 28 and the guide 34 lies on the rail 30. Mounting is simplified in this manner, because it is consequently unnecessary to pay attention to the orientation of the bed frame 32.

Figure 6:
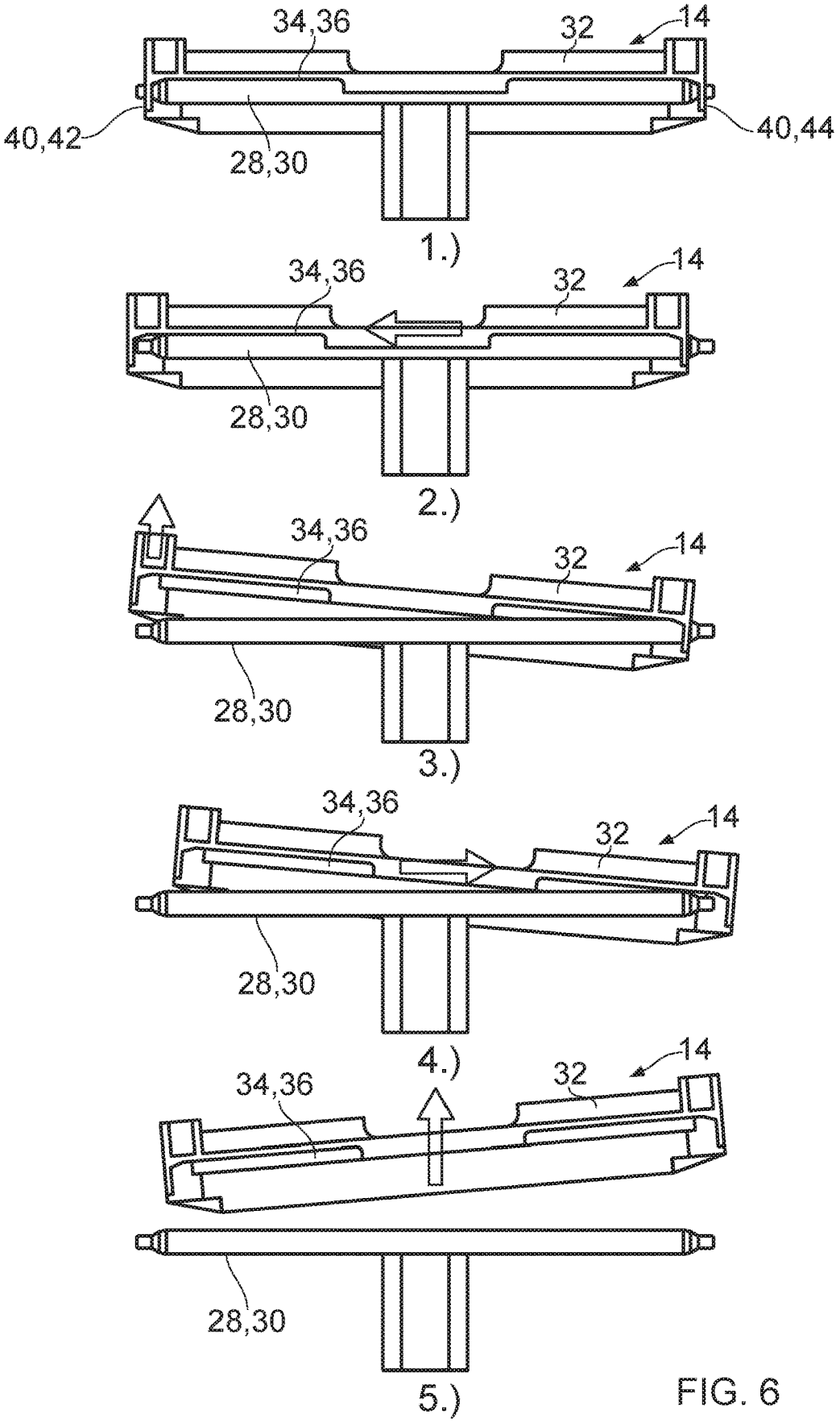
FIG. 6 is a schematic view showing a process for removing a bed frame in case of an anti-tilt device according to a second embodiment.

FIG. 6 shows a second embodiment of an anti-tilt device 40, wherein the undercut sections 42, 44 are formed only by the holes of the guides 34, 36 in the side walls of the bed frame. To guarantee that the horizontal rails 28, 30 are enclosed by the first and second undercut sections 42, 44 in the central position of the bed frame 32, the horizontal rails 28, 30 are made longer than the guides 34, 36 of the bed frame, so that the rails 28, 30 pass through the side walls of the bed frame 32 in the central position of the bed frame 32 (see step 1 in FIG. 6). The process for removing and mounting the bed frame 32 is carried out analogously to the embodiment according to FIG. 5.

Figure 7:
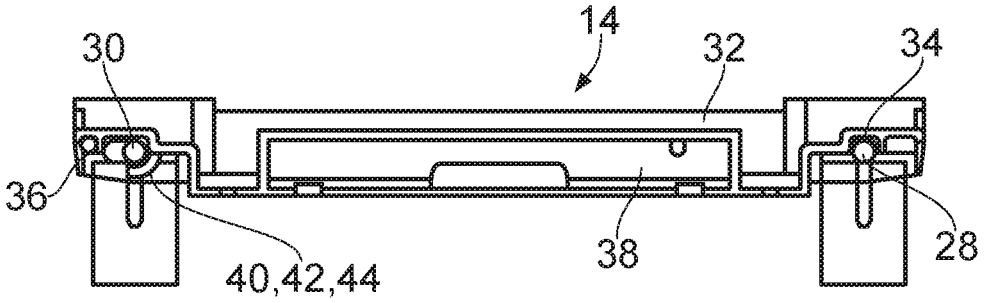
FIG. 7 is a schematic view showing a process for removing a bed frame in case of an anti-tilt device according to a third embodiment.
Figure 7:
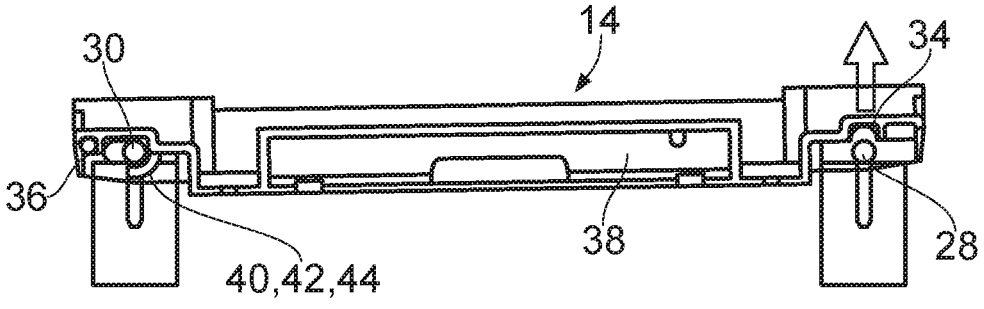
Figure 7:
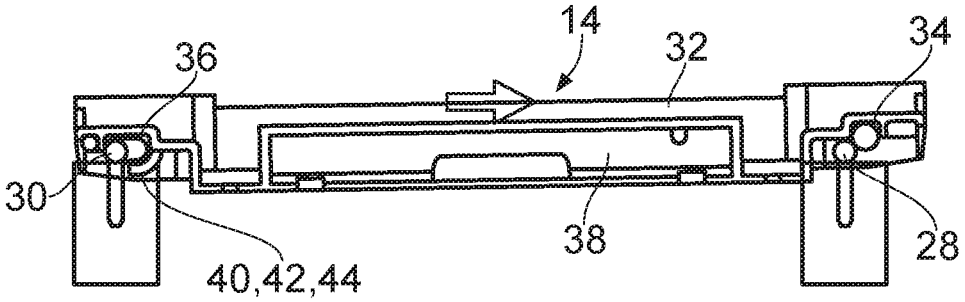
Figure 7:
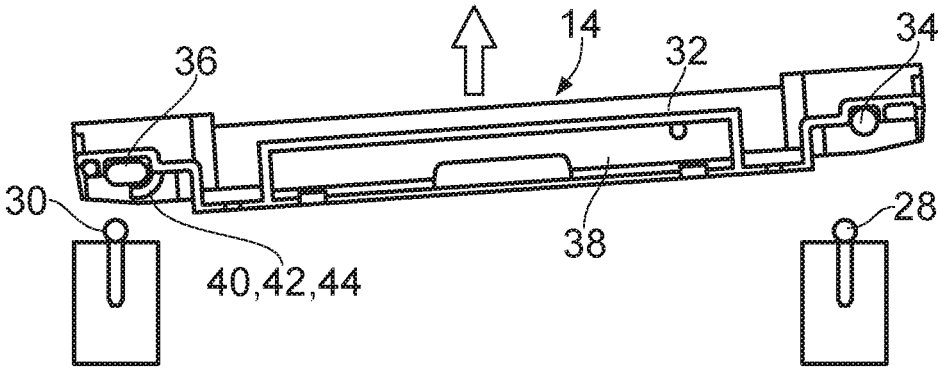

FIG. 7 shows a third embodiment of an anti-tilt device 40, wherein the two undercut sections 42, 44 are only formed on the second guide 36. The undercut sections 42, 44 are configured here such that the second rail 30 is enclosed in the inner-side area of the guide 36 only, while the rail 30 is not enclosed by the undercut sections 42, 44 in the outer-side area of the guide 36.

In a first step in the removal process, the bed frame 32 is brought into a horizontal position. The bed frame 32 is raised in the second step on the side of the first guide 34 until the first rail 28 has moved out of the guide 34. The bed frame is moved in the third step to the side of the first guide 34, so that the second horizontal rail 30 in the second guide 36 comes into the outer-side area of the guide 36, as a result of which the second rail 30 is released from the undercut sections 42, 44. The bed frame 32 can subsequently also be raised in the fourth step on the side of the second guide 36 and removed from the incubator chamber 12. The mounting of the bed frame 32 is carried out analogously in the reverse order.

Figure 8:
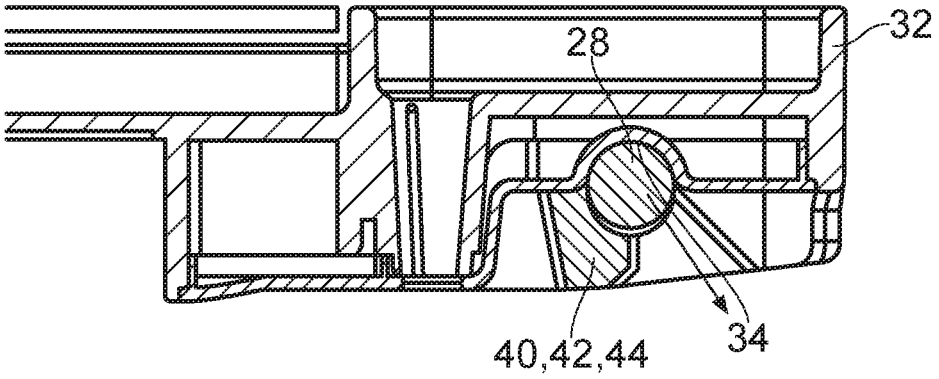
FIG. 8 is a detail view of an anti-tilt device according to a fourth embodiment.

FIG. 8 shows a fourth embodiment of an anti-tilt device 40. The two undercut sections 42, 44 are provided at the first guide 34 in this embodiment, while no undercut sections are provided at the second guide 36. The undercut sections 42, 44 enclose the horizontal rail 28 only partially, so that removal and insertion of the horizontal rail 28 are not possible in a direction at right angles to the plane of the bed frame 32, but in the direction indicated by the oblique arrow only. Removal and mounting of the bed frame 32 can therefore only be carried out in an oblique position of the bed frame 32 in the incubator chamber 12, for example, by raising the bed frame 32 on the side of the second guide 36 and by rotating the bed frame 32 about the horizontal rail 28.

Figure 9:
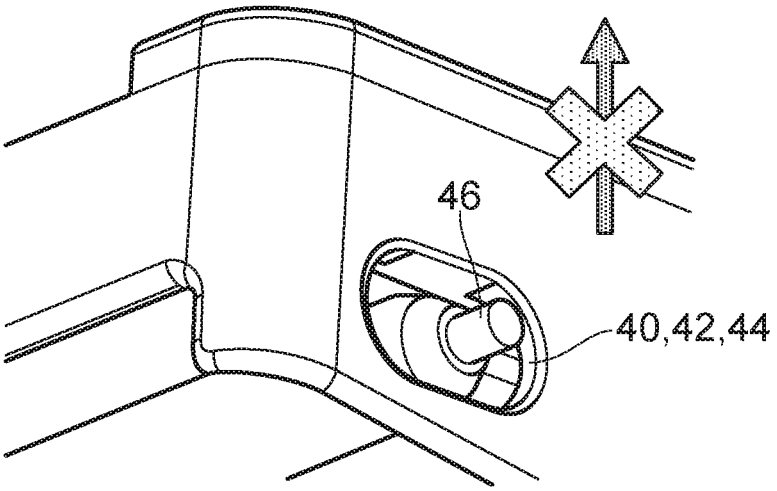
FIG. 9 is a detail view of an anti-tilt device according to a fifth embodiment.
Figure 9:
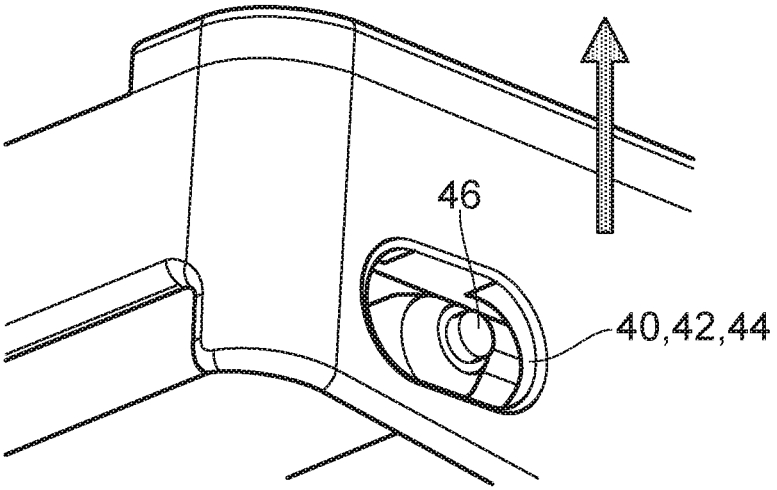

FIG. 9 shows a fifth embodiment of an anti-tilt device 40. The horizontal rails 28 and/or 30 have an expansion device 46 each at their ends, which expansion device 46 can be moved from a first, pulled-in position, see section (b), into a second, projecting position, see section (a), and the length of the horizontal rails 28, 30 in the pull-out direction is greater in the second position of the expansion device 46 than in the first position of the expansion device 46. The horizontal rails 28, 30 can be shortened in this manner for removing or mounting the bed frame 32. The expansion devices 46 pass through the holes of the side walls of the bed frame 32 in their second position, so that the side walls form each the two undercut sections 42 and 44 and thus prevent tilting of the bed frame 32.

In the first, pulled-in position of the expansion devices 46, the side walls of the bed frame 32 form no undercut sections 42 and 44 in the central position, and removal or mounting of the bed frame are possible in the vertical position.

Figure 10:
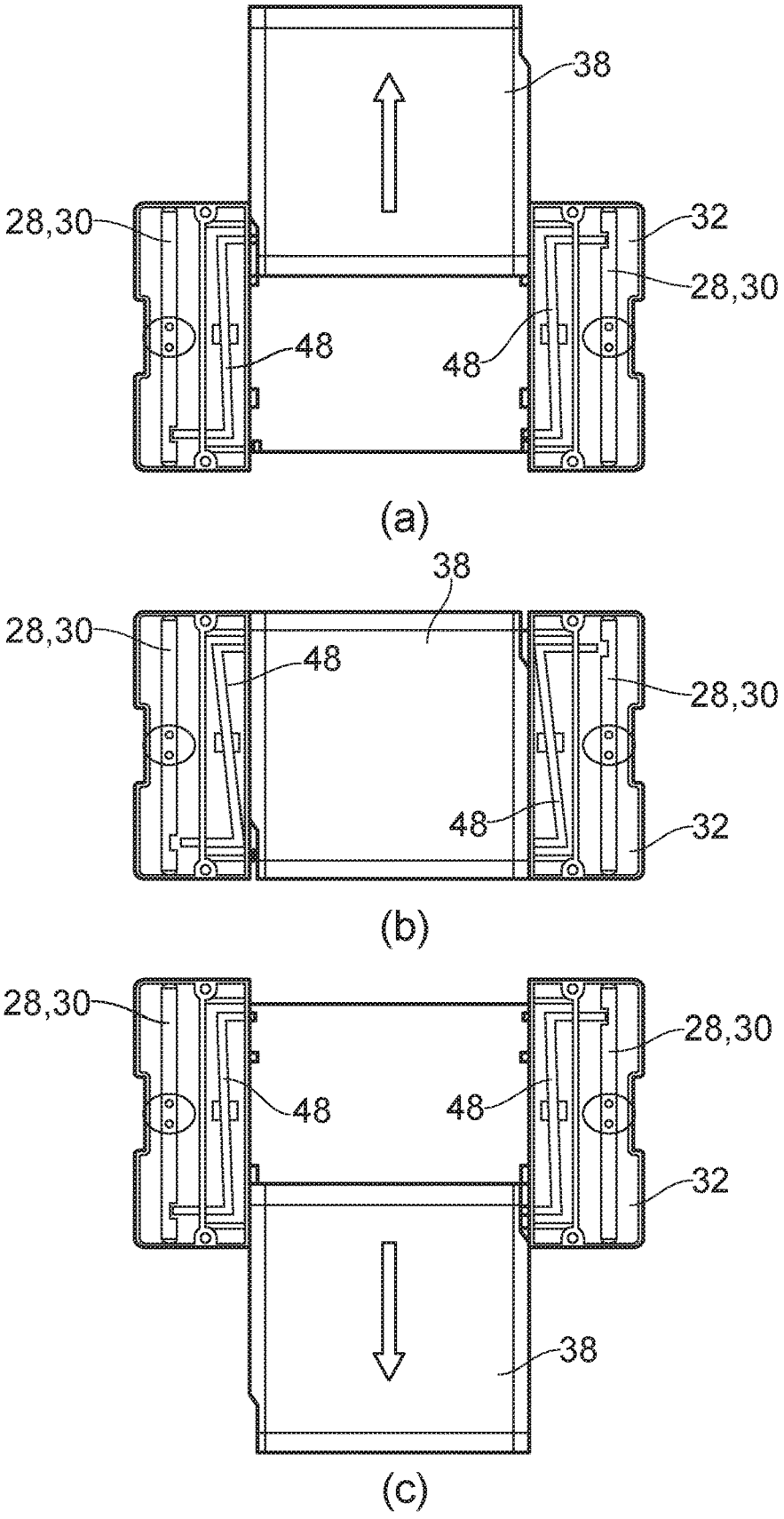
FIG. 10 is a detail view of an anti-tilt device according to a sixth embodiment.

FIG. 10 shows a sixth embodiment of an anti-tilt device 40. To prevent tilting of the bed frame 32 under a load on the pulled-out drawer 38, see section (a) of FIG. 4, a locking device 48 is provided in this embodiment, which locks the horizontal rail 28, 30 in an at least partially pulled-out position of the drawer 38 in order to prevent tilting of the bed frame 32, and releases the horizontal rail 28, 30 in a pushed-in position of the drawer in order to make possible the removal of the bed frame 32 from the incubator chamber 12 in a vertical direction.

In the embodiment shown in FIG. 10, the locking device 48 is configured as two Z-shaped toggle levers, which can each mesh with a first end with a recess of the respective horizontal rail 28, 30 and act on a surface of the drawer 38, which surface is configured as a cam, with a second end.

With the drawer 38 pushed in completely, the second ends of the levers are positioned by the cam of the drawer 38 such that the levers rotate such that the respective first ends of the levers release the horizontal rails 28, 30 and the locking device 48 is unlocked (section (b)).

If the drawer 38 is pulled out of the bed frame 32 in one direction or the other, the two ends of the levers are either free or are moved by the cam of the drawer 38 such that the levers rotate about a respective central axis of rotation and the first ends of the levers mesh with the horizontal rails 28, 30, and the locking device 48 is locked (sections (a) and (c)).

Figure 11:
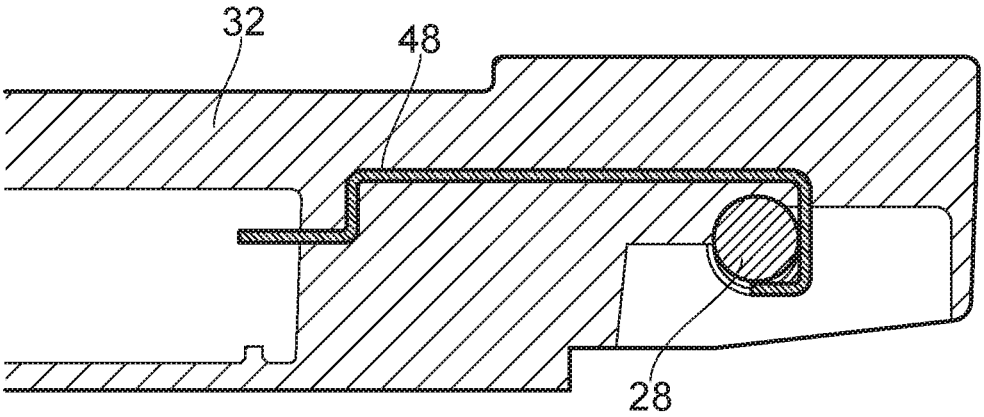
FIG. 11 is a detail view of an anti-tilt device according to seventh embodiment.
Figure 11:
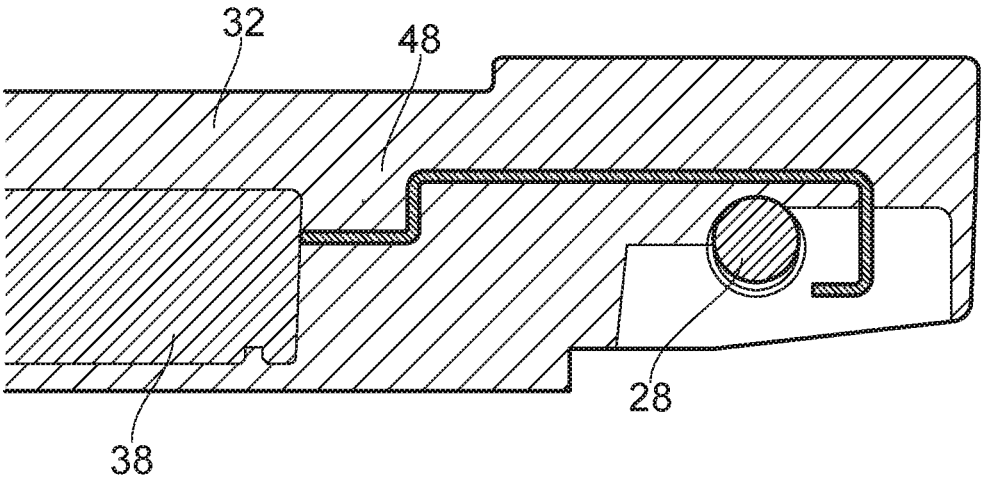

FIG. 11 shows a seventh embodiment of an anti-tilt device 40 with an alternative locking device 48. The locking device 48 comprises a blocking element each, which forms at a first end an undercut, which can enclose the horizontal rail 28, 30 and is in contact with a second end with a surface of the drawer 38, which surface is configured as a cam. The arrangement of the locking elements is, for example, analogous to the preceding embodiment.

Four blocking elements may also be arranged at the two respective ends of the guides 34, 36 analogously to the four undercut sections of the preceding embodiments.

Section (a) shows the locking device 48 with the drawer 38 pulled out completely or partially, and the drawer 38 acts on the blocking element in the direction of the arrow and the first end of the blocking element thus encloses the horizontal rail 28, 30. The drawer 38 is configured analogously to the embodiment according to FIG. 10 with a cam, and the blocking element is either free or is in contact with the indentation of the cam of the drawer 38 in the position shown in section (a).

The drawer 38 is pushed in section (b) and the cam of the drawer moves the blocking element in the direction of the arrow, so that the first end of the blocking element releases the horizontal rail 28, 30.

The features of the different embodiments of the anti-tilt device 40 may, in particular, also be combined with one another.

FIGS. 12 through 15 show different embodiments of a centering device 50, which acts on the bed frame 32 to move it into a central position in order to guarantee reliable positioning of the bed frame 32 in the incubator chamber 12. It is ensured in this manner that the bed frame 32, which can be pulled out, is positioned optimally in the incubator chamber 12 and, for example, the air supply openings of a heating device of the incubator are not covered completely or partially by the bed frame 32, which can be pulled out.

Figure 12:
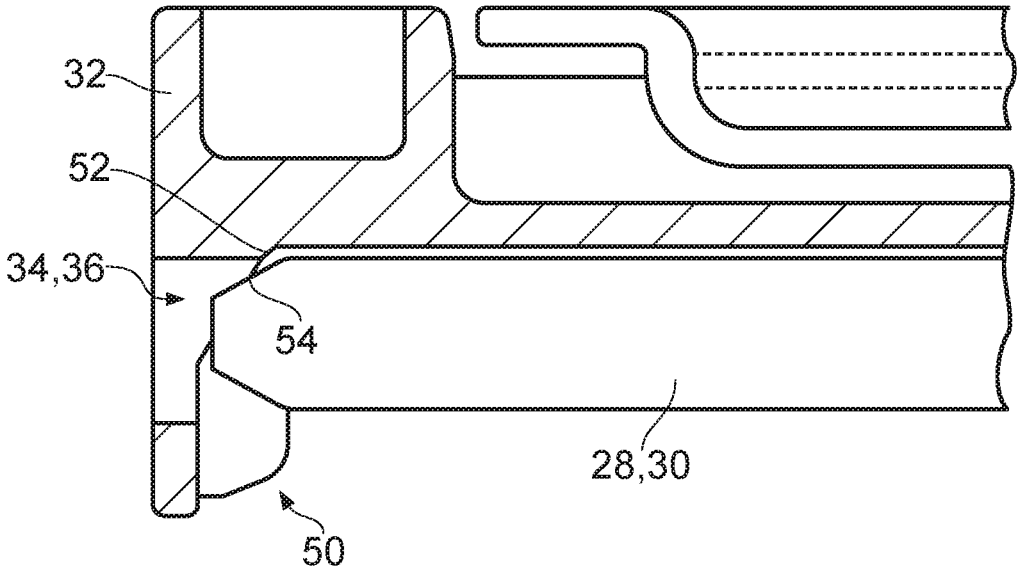
FIG. 12 is a detail view of a centering device according to a first embodiment.
Figure 13:
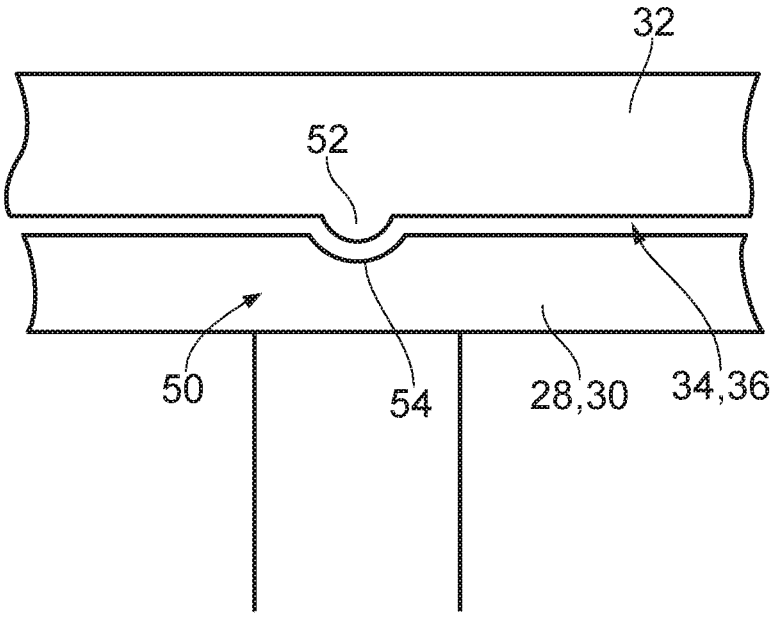
FIG. 13 is a detail view of a centering device according to a second embodiment.

In the embodiments according to FIGS. 12 through 13, the centering device 50 has a first mechanical centering element 52 each in the guide 34, 36 and a second mechanical centering element 54 in the horizontal rail 28, 30, which mesh with one another in a positive-locking manner in the central position of the bed frame. Positioning of the bed frame 32 within the incubator chamber 12 is thus made possible in a simple mechanical manner.

In FIG. 12, the two mechanical centering elements 52 are formed by a chamfer each in the end area of the horizontal rails 28, 30 and of the guides 34, 36. The bed frame is acted on in this manner by its own weight to move it into the central position. In addition, the tapering of the horizontal rails 28, 30, which is formed by the chamfer, facilitates the installation and the removal of the bed frame 32.

FIG. 13 shows an alternative embodiment of the centering device 50, in which the first mechanical centering elements 52 of the guides 34, 36 are formed by bead-like bulges and the second mechanical centering elements 54 in the horizontal rails 28, 30 are formed by grooves, which extend each at right angles to the axis of the horizontal rails 28, 30. If the bed frame 32 is in the area of the central position, the bed frame is acted on by its own weight to move it into the central position. As an alternative, the grooves may be formed in the guides 34, 36 and the bulges in the rails 28, 30.

Figure 14:
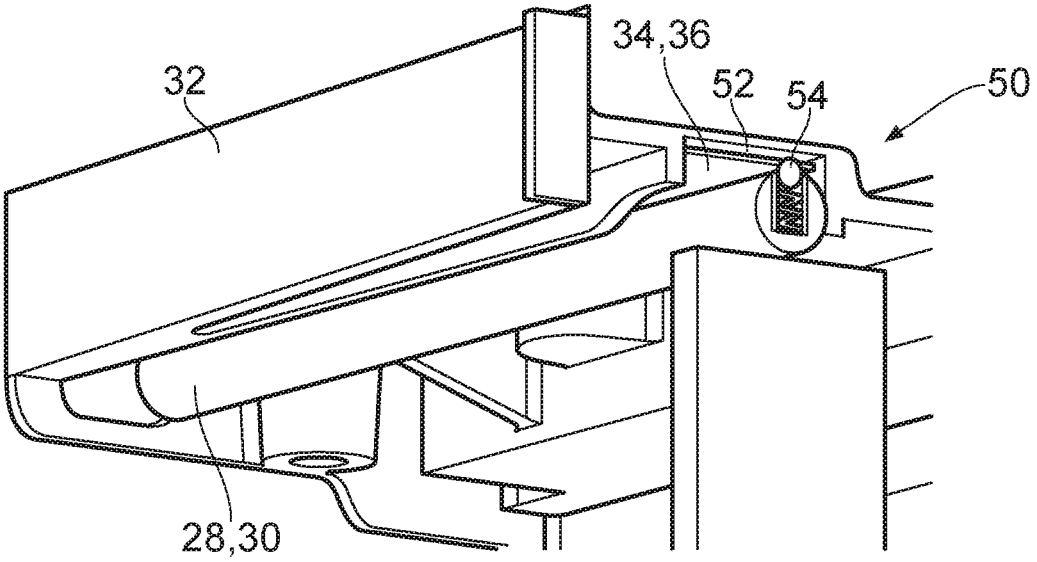
FIG. 14 is a detail view of a centering device according to a third embodiment.

FIG. 14 shows another embodiment of the centering device 50, in which the first mechanical centering elements 52 of the guides 34, 36 are formed by grooves extending at right angles to the axis of the horizontal rails 28, 30 and the second mechanical centering elements 54 in the horizontal rails 29, 30 are formed by a spring-mounted ball. The ball can be pressed by the spring force into a recess in the horizontal rail 28, 30. If the bed frame 32 is in the central position, the ball is pressed by the spring into the groove of the guide 34, 36 and it thus acts on the bed frame 32 to move into its central position. Due to the second mechanical centering element 54 being configured as an elastic element, it is possible to move the bed frame along the horizontal rails 28, 30 without vertical movement.

Figure 15:
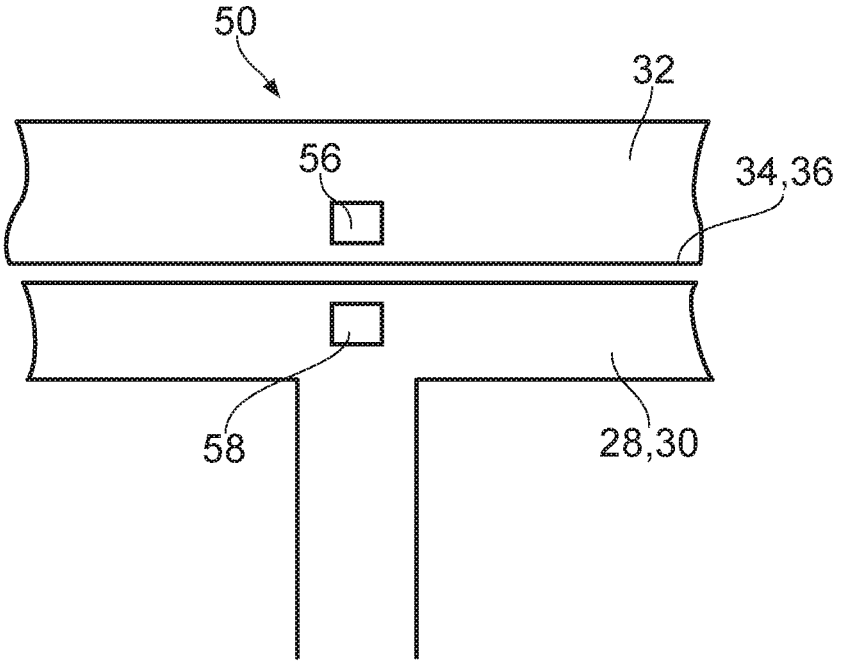
FIG. 15 is a detail view of a centering device according to a fourth embodiment.

FIG. 15 shows another embodiment of the centering device 50, in which the centering device 50 has a first magnetic centering element 56 in the guide 34, 36 and a second magnetic centering element 58 in the rail 28, 30. The magnetic forces between the first and second magnetic centering elements 56, 58 act on the bed frame 32 to move it into the central position. This makes possible a contactless action into the central position. In the embodiment shown, the magnetic centering elements 56, 58 are integrated in the bed frame 32 and in the rail 28, 30, preferably cast in plastic, as a result of which simple cleaning of the centering device 50 is made possible. For example, two strong permanent magnets or one strong permanent magnet and one ferromagnetic or paramagnetic element may be provided as magnetic centering elements 56 and 58.

The different features of the embodiments of the centering device 50 shown in FIGS. 12 through 14 may also be combined with one another as desired. Instead of the vertical arrangement of the centering elements shown in the figures, it is possible to provide, for example, a lateral arrangement of the centering elements especially for the first horizontal rail 28 and the first guide 34.

The patient bed assembly unit 14 with the bed frame 32 and with the drawer 38 will be described below on the basis of FIGS. 16 through 23. The bed frame 32 has a guide 60 for the drawer 38. The guide 60 is configured to make possible a movement of the drawer 38 from a central pushed-in position in the bed frame 32 along a first pull-out direction of the guide 60 into a pulled-out position of the drawer 38, and to make possible a movement of the drawer 38 from the central pushed-in position in the bed frame 32 along a second pull-out direction of the guide 60, which direction is opposite the first pull-out direction, into a pulled-out position of the drawer 38.

A drawer-centering device 62 is provided, which acts on the drawer 38 to move the drawer 38 into the central pushed-in position.

Figure 16:
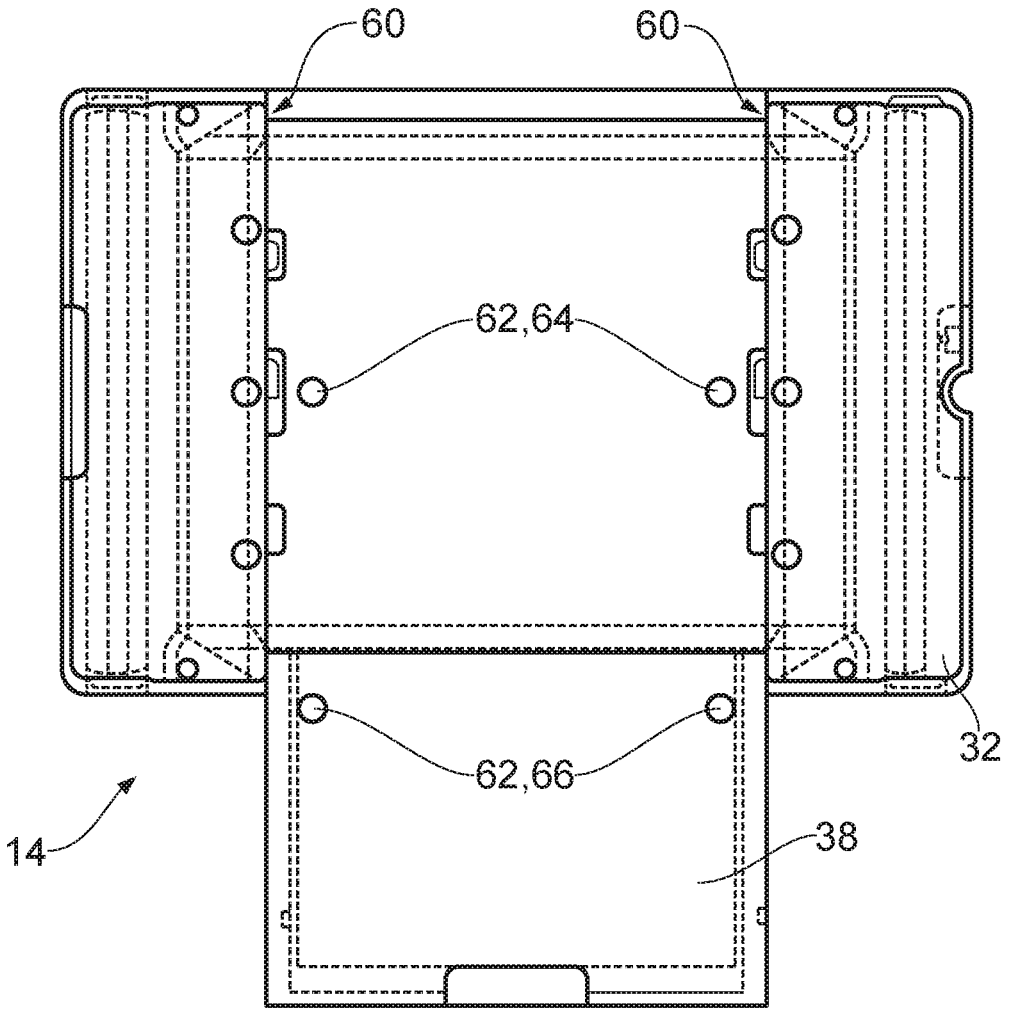
FIG. 16 is a detail view of a drawer-centering device according to a first embodiment.

The drawer-centering device 62 in the embodiment shown in FIG. 16 has two first magnetic drawer-centering elements 64 in the guide 60 and two magnetic drawer-centering elements 66 in the drawer 38, wherein the magnetic forces between the first and second magnetic drawer-centering elements 64, 66 act on the drawer 38 to move it into the central pushed-in position. For example, two strong permanent magnets or one strong permanent magnet and one ferromagnetic or paramagnetic element may be provided as magnetic drawer-centering elements 64 and 66.

The magnetic drawer-centering elements 66 and 64 are inserted in the embodiment shown into recesses of plastic components of the bed frame 32 and of the drawer 38, and the recesses are closed with a cover and welded by ultrasonic welding. As an alternative, the magnetic drawer-centering elements 66 and 64 may be cast in or bonded in.

At least one first magnetic drawer-centering element 64 and one second magnetic drawer-centering element 66, which may be arranged, for example, in the center of the drawer 38, are sufficient, in principle.

Figure 17:
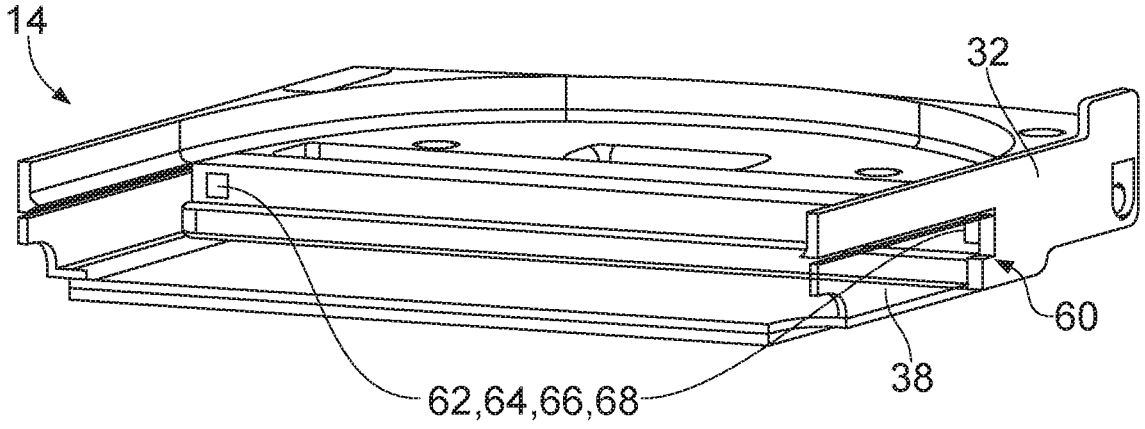
FIG. 17 is a detail view of a drawer-centering device according to a second embodiment.

FIG. 17 shows an alternative embodiment, in which four first and four second magnetic drawer-centering elements 64, 66 each are provided, which are arranged each in the area of the outer ends of the guide 60 and of the drawer 38, respectively. The four pairs of the magnetic drawer-centering elements 64, 66 are located opposite each other in the central pushed-in position and they mutually attract each other and act on the drawer 38 to move it into its central pushed-in position.

In the embodiment shown, the drawer-centering elements 64, 66 are arranged each, moreover, such that they form end position elements 68, which define a fully pulled-out position in the respective pull-out directions and act on the drawer to move it into the fully pulled-out position, as a result of which the user receives during the pulling out a haptic feedback that the drawer is in the fully pulled-out position and that the drawer 38 would be removed from the bed frame 32 during a further pulling out. In the embodiment shown, the magnetic drawer-centering elements 64, 66 of the respective opposite ends of the drawer 38 and of the guide 60 are located opposite each other and they mutually attract each other.

It is also possible to combine the drawer-centering elements 64, 66 of the two embodiments shown in FIGS. 16 and 17 with one another.

FIGS. 18 through 21 show each an embodiment of the drawer-centering device 62 with a first mechanical drawer-centering element 70 in the guide 60 and with a second mechanical drawer-centering element 72 in the drawer 38, which mesh with one another in a positive-locking manner in the central pushed-in position of the drawer 38.

Figure 18:
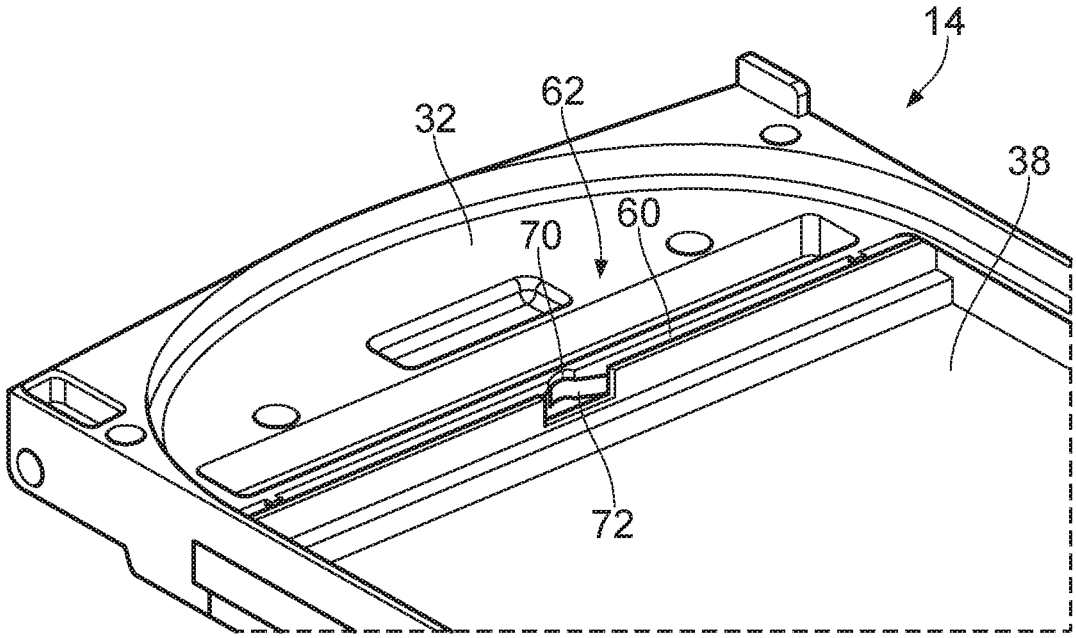
FIG. 18 is a detail view of a drawer-centering device according to a third embodiment.

In the embodiment shown in FIG. 18, the second mechanical drawer-centering element 72 is configured as a metal spring, which forms an elastic bulge, which is elastically prestressed against the guide 60. The first mechanical drawer-centering element 70 is configured as a correspondingly shaped groove in the guide 60, so that the metal spring meshes with the groove in the central pushed-in position of the drawer 38 and thus it acts on the drawer to move it into its central pushed-in position.

As an alternative, the second mechanical drawer-centering element 72 may be made in one piece with the body of the drawer as an elastic plastic element, which meshes, analogously to the metal spring according to FIG. 18, with a groove in the guide 60 and thus acts on the drawer to move it into its central pushed-in position.

Figure 19:
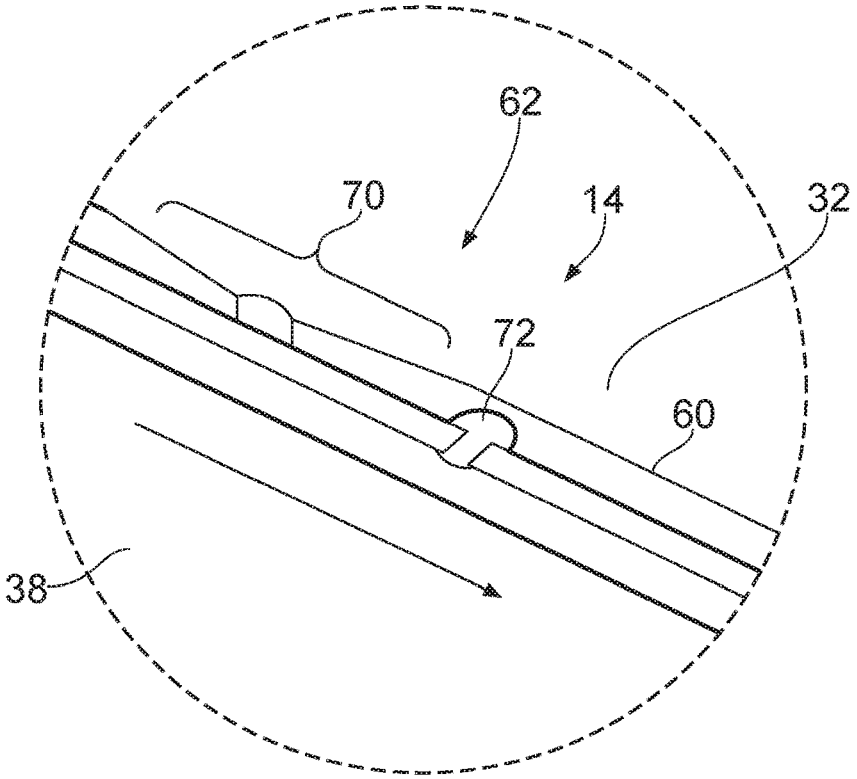
FIG. 19 is a detail view of a drawer-centering device according to a fourth embodiment.

FIG. 19 shows an alternative embodiment, in which the second mechanical drawer-centering element 72 is an elastic component embedded in the wall of the drawer, which forms a projection. The guide 60 is configured such that the embedded elastic component is movable essentially freely in the pull-out direction. The corresponding first drawer-centering element 70 of the guide 60 has an approach area, in which the guide 60 approaches the wall of the drawer 38, so that the embedded elastic component undergoes elastic deformation during a corresponding movement of the drawer 38, and a groove in the center of the approach area, wherein the embedded elastic component is located in the groove in the central pushed-in position of the drawer 38. Thus, before the central pushed-in position is reached, the user receives a haptic feedback that the central pushed-in position will be reached shortly.

Figure 20:
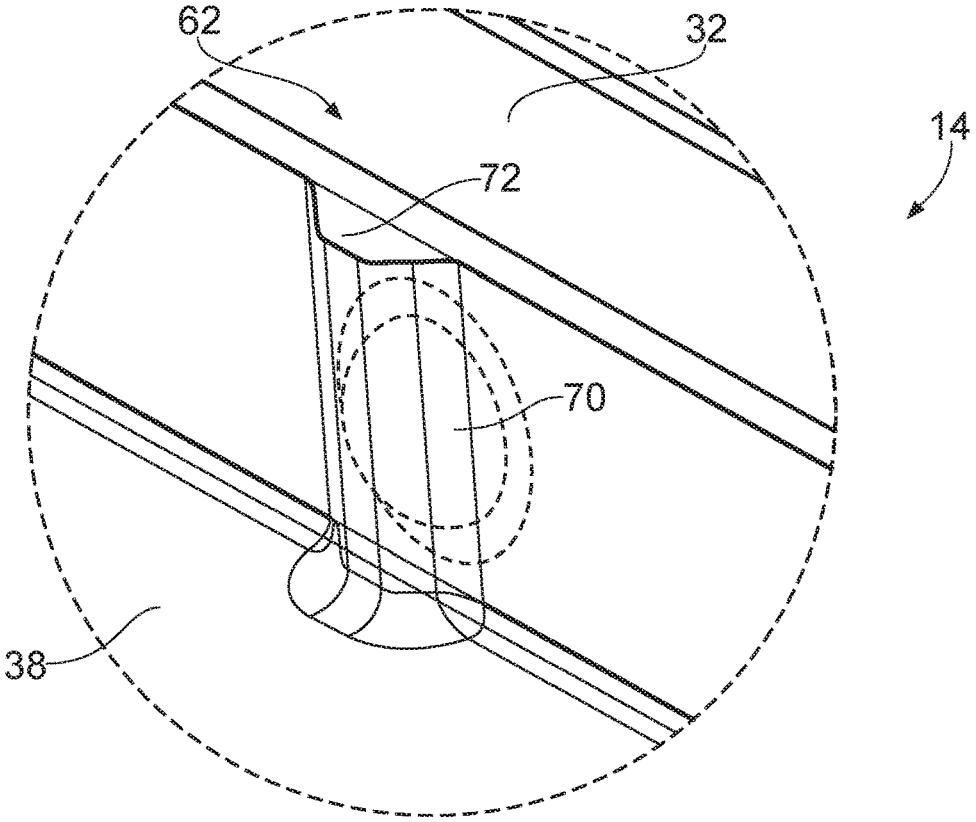
FIG. 20 is a detail view of a drawer-centering device according to a fifth embodiment.

FIG. 20 shows another embodiment, in which the first mechanical drawer-centering element 70 of the guide 60 is a spring-mounted ball prestressed against the drawer and in which the second mechanical drawer-centering element 72 is a vertically extending groove in the wall of the drawer. The mode of operation is essentially analogous to that of the centering device 50 from FIG. 14. As an alternative to a vertically extending groove, a hole or another depression may also be provided in the side wall of the drawer.

Figure 21:
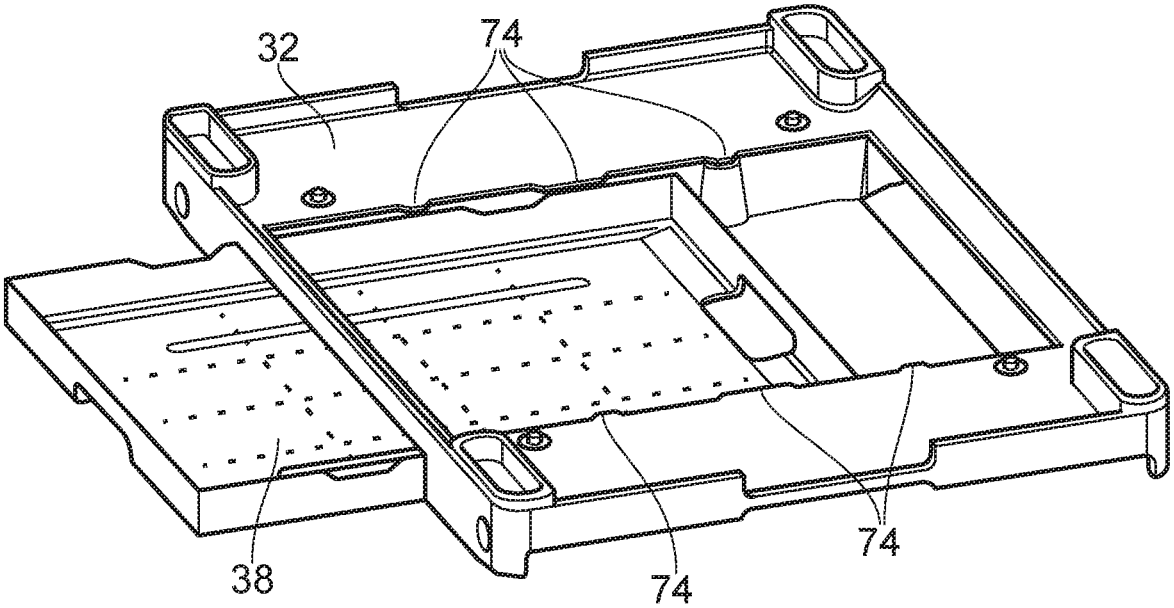
FIG. 21 is a perspective view of a patient bed assembly unit according to the present invention.
Figure 22:
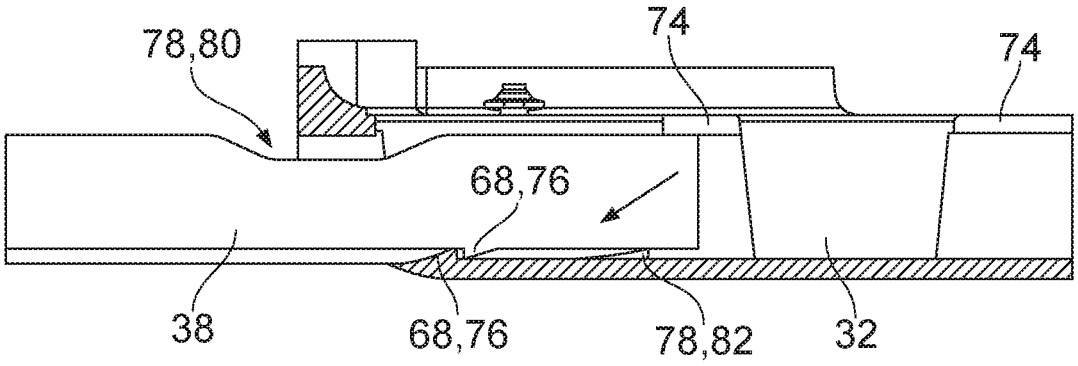
FIG. 22 is a detail view of the patient bed assembly unit from FIG. 21 with anti-tilt device and end stop.
Figure 23:
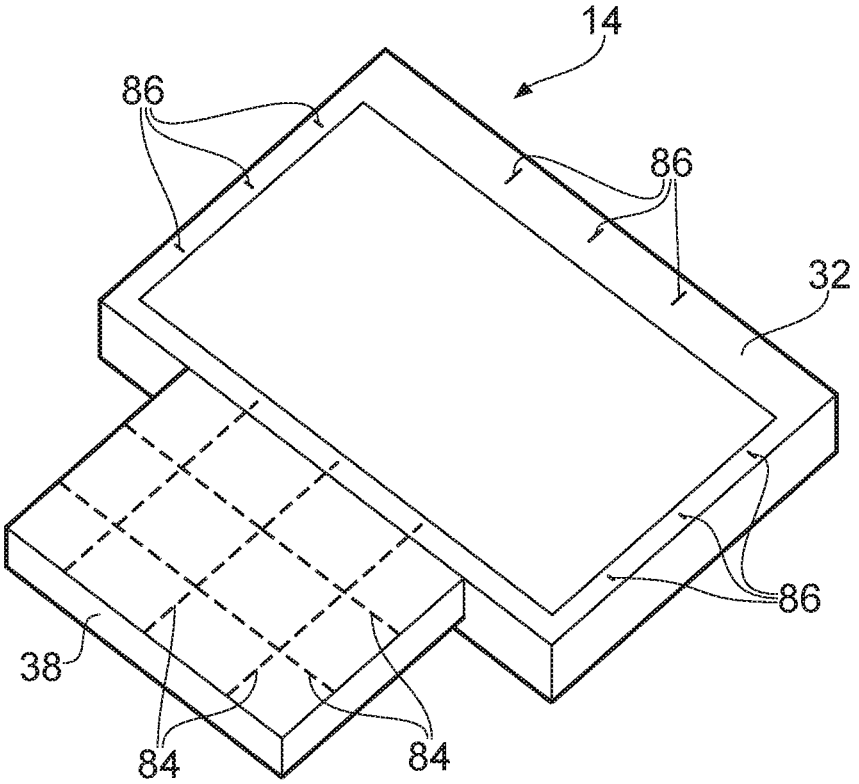
FIG. 23 is a schematic view of a patient bed assembly unit according to the present invention with positioning marks.

FIGS. 21 through 23 show a drawer anti-tilt device 74 of the patient bed assembly unit 14, which prevents a downward tilting of the drawer 38 relative to the bed frame 32 about an axis extending at right angles to the pull-out directions.

To make it possible to take X-ray pictures with the lowest radiation dose possible, a hole is provided in the bed frame 32 above the interior of the drawer 38 for the X-ray cassette and for the X-ray detector. Thus, only the mattress with the reclining surface as well as a possibly present support element for the mattress are arranged between the patient and the X-ray cassette, on the one hand, and the X-ray detector, on the other hand. The support element may be made, in particular, from a material different from the material of the rest of the bed frame 32, and this other material is preferably more transparent for X-rays, and it is, e.g., carbon.

To prevent the drawer 38 from tilting, especially under a load in a pulled-out state, and hence under a pressure against the mattress or the support element of the mattress, the drawer anti-tilt device 74 is provided at the guide 60 in the upper area in the form of sections of projections, which are arranged above the side walls of the drawer 38, and thus they absorb a torque exerted on the drawer 38, as a result of which the torque is transmitted to the bed frame 32.

The torque is transmitted from the bed frame 32 via the anti-tilt device 40 according to the preceding figures to the horizontal rails 28, 30 and to the housing of the incubator 10.

FIG. 22 shows another embodiment, in which the drawer 38 and the bed frame 32 have end position elements 68 each, which define a fully pulled-out position in the respective pull-out directions and block a further pulling out of the drawer 38 in the fully pulled-out position.

The end position elements 68 are configured each as mechanical stop elements 76 and are in contact with one another in a positive-locking manner in the fully pulled-out position shown in FIG. 22. The stop elements 76 have a sawtooth-shaped configuration each. This makes possible a simple movement of the stop elements 76 over each other when the drawer 38 is being moved in the direction of the oblique flank of the sawtooth shape. By contrast, the vertical surfaces striking each other block the movement in the other direction.

A drawer-removing device 78, which makes it possible to abolish the positive-locking connection of the stop elements 76 and the removal of the drawer 38 from the bed frame 32, is provided in the embodiment shown. This makes possible a simple mounting and removal of the drawer 38 in the bed frame 32.

In the embodiment shown, the drawer-removing device 78 is formed by an indentation 80 in the side wall of the drawer 38 as well as by a rounding 82 of the drawer bottom together with the arrangement of the stop elements 76. This makes it possible to raise the drawer 38 selectively in the fully pulled-out position by rotating the drawer. The upper side wall of the bed frame 32 is received now in the indentation 80 of the drawer. The stop element 76 of the drawer is raised now to the extent that it becomes disengaged from the stop element 76 of the bed frame 32 and the drawer can thus be removed from the bed frame 32.

The insertion of the drawer 38 back into the bed frame 32 can be carried out in the reverse order, on the one hand, and, on the other hand, this is also possible in another tilted position based on the sawtooth shape of the stop elements 76 without problems.

As an alternative, an end position element 68 may be configured as an elastic element, for example, at the axial end of the side wall of the drawer and come into contact with the upper side wall of the bed frame 32. The end position element 68 advantageously forms a mechanical stop element 76, on the one hand, and, on the other hand, a drawer-removing device 78 by the end position element 68 having such a flexible configuration that it makes it possible to remove the drawer in case of the application of a strong force and thus it also gives the user a haptic feedback for the fully pulled-out position. Another advantage of the elastic element 68 is that noise is minimized during the meshing of the end stop.

To make it possible to position an X-ray cassette or an X-ray detector optimally in relation to the newborn lying on the reclining surface and to avoid faulty pictures, the drawer 38 has, as is shown in FIG. 23, a first positioning mark 84, and the bed frame 32 has a second positioning mark 86, the first positioning mark 84 coinciding with the second positioning mark 86 in the central pushed-in position of the drawer 38. It is possible, as an alternative or in addition, for the second positioning marks 86 to be arranged on a side wall 18 of the incubator.

While specific embodiments of the invention have been shown and described in detail to illustrate the application of the principles of the invention, it will be understood that the invention may be embodied otherwise without departing from such principles.

The invention claimed is:

1. A thermotherapy device for newborns, the thermotherapy device comprising:

a patient bed assembly unit; and a positioning device for the patient bed assembly unit, wherein:

the positioning device has a first horizontal rail in an area of a first end face of the thermotherapy device and a second horizontal rail in the area of a second end face of the thermotherapy device;

the patient bed assembly unit comprises a bed frame, which has a first guide and a second guide for the horizontal rails;

the guides are configured to make possible a movement of the bed frame from a central position in the thermotherapy device along a first pull-out direction of the horizontal rails into a pulled-out position of the bed frame, and to make possible a movement of the bed frame from the central position in the thermotherapy device along a second pull-out direction of the horizontal rails, which is opposite the first pull-out direction, into a pulled-out position of the bed frame; and an anti-tilt device, which prevents tilting of the bed frame about an axis extending at right angles to the horizontal rails in the central position and in a pulled-out position.

2. A thermotherapy device in accordance with claim 1, wherein the positioning device and the bed frame are configured to make it possible to remove the bed frame from the positioning device in a vertical direction.

3. A thermotherapy device for newborns the thermotherapy device comprising:

a patient bed assembly unit; and a positioning device for the patient bed assembly unit, wherein the patient bed assembly unit comprises a bed frame, wherein the bed frame and the positioning device are configured to make possible a movement of the bed frame from a desired position relative to the positioning device along at least one pull-out direction into a pulled-out position of the bed frame and to make it possible to remove the bed frame from the positioning device in a vertical direction; and an anti-tilt device, which prevents tilting of the bed frame about an axis extending at right angles to the horizontal rails in the desired position and in the pulled-out position.

4. A thermotherapy device in accordance with claim 3, wherein:

the positioning device comprises a first horizontal rail in an area of a first end face of the thermotherapy device and a second horizontal rail in an area of a second end face of the thermotherapy device; and the bed frame has a first guide and a second guide for the horizontal rails, wherein the guides are configured to make possible the movement of the bed frame from a central position in the thermotherapy device along a first pull-out direction of the horizontal rails into a pulled-out position of the bed frame, and the guides are configured to make possible the movement of the bed frame from the central position in the thermotherapy device along a second pull-out direction of the horizontal rails, which direction is opposite the first pull-out direction, into a pulled-out position of the bed frame.

5. A thermotherapy device in accordance with claim 4, wherein the anti-tilt device at at least one of the guides of the bed frame has a first undercut section and a second undercut section, which are located at spaced locations from one another in the pull-out direction and wherein both undercut sections at least partially enclose in the central position the associated horizontal rail in the vertical direction.

6. A thermotherapy device in accordance with claim 4, wherein the horizontal rails have an expansion device, which can be moved from a first position into a second position, wherein a length of the horizontal rails in the pull-out direction is greater in the second position of the expansion device than the length of the horizontal rails in the pull-out direction in the first position of the expansion device.

7. A thermotherapy device in accordance with claim 3, wherein a height adjustment device is provided, which is configured to set the height of the first and second horizontal rails individually.

8. A thermotherapy device in accordance with claim 3, wherein the horizontal rails are configured as T-shaped carriers, which enclose a horizontal rail element and a central vertical support element.

9. A thermotherapy device in accordance with claim 3, further comprising a centering device acting on the bed frame to move the bed frame into a central position.

10. A thermotherapy device in accordance with claim 9, wherein the centering device comprises a first mechanical centering element in the guide and a second mechanical centering element in the rail, which mesh with one another in a positive-locking manner in the central position of the bed frame.

11. A thermotherapy device in accordance with claim 10, wherein at least one of the first or second mechanical centering element is acted on by an elastic element against the respective other mechanical centering element.

12. A thermotherapy device in accordance with claim 10, wherein at least one of the mechanical centering elements forms a gradient, along which the patient bed assembly unit is transported by a patient bed assembly unit weight into the central position of the bed frame.

13. A thermotherapy device in accordance with claim 9, wherein the centering device comprises a first magnetic centering element in the guide and a second magnetic centering element in the rail, wherein the magnetic forces between the first and second magnetic centering elements act on the bed frame to move the bed frame into the central position.

14. A thermotherapy device in accordance with claim 3, wherein the patient bed assembly unit comprises a drawer, which can be pulled out of a pushed-in position in the bed frame in at least one of the pull-out directions.

15. A thermotherapy device in accordance with claim 14, wherein the bed frame comprises a guide for the drawer and the guide is configured to make possible a movement of the drawer from a central pushed-in position in the bed frame along a first pull-out direction of the guide into a pulled-out position of the drawer, and to make possible a movement of the drawer from the central pushed-in position in the bed frame along a second pull-out direction of the guide, which direction is opposite the first pull-out direction, into a pulled-out position of the drawer.

16. A thermotherapy device in accordance with claim 15, wherein a drawer-centering device is provided, which acts on the drawer to move the drawer into the central pushed-in position.

17. A thermotherapy device in accordance with claim 16, wherein the drawer-centering device has a first magnetic drawer-centering element in the guide and a second magnetic drawer-centering element in the drawer, wherein the magnetic forces between the first and second magnetic drawer-centering elements act on the drawer to move it into the central pushed-in position.

18. A thermotherapy device in accordance with claim 16, wherein the drawer-centering device has a first mechanical drawer-centering element in the guide and a second mechanical drawer-centering element in the drawer, which have a positive-locking mesh with one another in the central pushed-in position of the drawer.

19. A thermotherapy device in accordance with claim 14, wherein the drawer can be removed from the guide, and a drawer anti-tilt device is provided, which transmits a torque acting on the drawer directly to the bed frame and prevents the downward tilting of the drawer relative to the bed frame about an axis extending at right angles to the pull-out directions.

20. A thermotherapy device in accordance with claim 14, wherein the drawer and the bed frame have end position elements each, which define a fully pulled-out position in the respective pull-out directions and block a further pulling out of the drawer in the fully pulled-out position and act on the drawer to move the drawer into the fully pulled-out position.

21. A thermotherapy device in accordance with claim 20, wherein the end position elements are configured as magnetic stop elements, wherein magnetic forces between the magnetic stop elements act on the drawer to move the drawer into the fully pulled-out position.

22. A thermotherapy device in accordance with claim 20, wherein the end position elements are configured as mechanical stop elements and are in a positive-locking contact with one another in the fully pulled-out position.

23. A thermotherapy device in accordance with claim 22, further comprising a drawer-removing device, which makes possible the separation of the positive-locking connection of the stop elements and removal of the drawer from the bed frame.

24. A thermotherapy device in accordance with claim 14, wherein the drawer has a first positioning mark, which is configured such that the drawer coincides with a second positioning mark on the bed frame and/or on a component of a thermotherapy device, which component belongs to the patient bed assembly unit, in the central pushed-in position of the drawer.

25. A thermotherapy device in accordance with claim 14, further comprising a locking device, which locks the horizontal rail in an at least partially pulled-out position of the drawer in order to prevent tilting of the bed frame, and unlocks the horizontal rail in a pushed-in position of the drawer in order to make possible the removal of the bed frame from the positioning device.

* * * * *